United States Patent [19]

Kubo

[11] Patent Number: 4,989,695

[45] Date of Patent: Feb. 5, 1991

[54] APPARATUS FOR PERFORMING GROUP CONTROL ON ELEVATORS UTILIZING DISTRIBUTED CONTROL, AND METHOD OF CONTROLLING THE SAME

[75] Inventor: Susumu Kubo, Fuchu, Japan

[73] Assignee: Kabushiki Kaisha Toshiba, Kawasaki, Japan

[21] Appl. No.: 329,830

[22] Filed: Mar. 28, 1989

[30] Foreign Application Priority Data

Mar. 31, 1988 [JP] Japan ..... 63-78789

[51] Int. Cl.[5] ..... B66B 1/18

[52] U.S. Cl. ..... 187/101; 187/124

[58] Field of Search ..... 187/101, 102, 124, 127; 364/131, 133, 424.01

[56] References Cited

U.S. PATENT DOCUMENTS

| | | | |
|---|---|---|---|
| 4,114,730 | 9/1978 | Means et al. | 187/101 |
| 4,350,225 | 9/1982 | Sakata et al. | 187/102 |
| 4,567,560 | 1/1986 | Polis et al. | 187/102 X |
| 4,709,788 | 12/1987 | Harada | 187/124 |
| 4,760,896 | 8/1988 | Hamaguchi | 187/124 |
| 4,762,204 | 8/1988 | Blain et al. | 187/101 |
| 4,860,207 | 8/1989 | Kubo | 187/124 X |

FOREIGN PATENT DOCUMENTS 61-273477 12/1986 Japan .

62-116483 5/1987 Japan .

*Primary Examiner*—A. D. Pellinen

*Assistant Examiner*—W. E. Duncanson, Jr.

*Attorney, Agent, or Firm*—Oblon, Spivak, McClelland, Maier & Neustadt

[57] ABSTRACT

An apparatus for performing group control on elevators, wherein a plurality of elevators are operated for a plurality of floors, a predetermined evaluation calculation is performed for each of the plurality of elevators upon generation of a hall call, an optimum elevator car is selected on the basis of an evaluation calculation result, and the selected elevator car is assigned to the hall call, thereby responding to the hall call, the apparatus, comprises a unit controller, arranged in units of cars of the elevators, for controlling unit control of each car and inputting/outputting information associated with its own car, a plurality of group controllers for performing the evaluation calculation for determining hall-call assignment in units of cars on the basis of the information associated with its own car and for performing group management of each elevator car on the basis of an evaluation calculation result, and a communicating circuit for causing the plurality of group controllers to communicate with each other through a first data field and causes the unit control means and the group controllers to communicate with each other through a second data field independent of the first data field.

12 Claims, 19 Drawing Sheets

DATA FIELD OF TOTAL SYSTEM

| |
|---|
| NO. 1 CAR ELEVATOR STATUS TABLE |
| NO. 1 CAR RESPONSE CONTROL TABLE |
| ⋮ |
| NO. n CAR ELEVATOR STATUS TABLE |
| NO. n CAR RESPONSE CONTROL TABLE |
| MISCELLANEOUS TABLES |

FIG. 10A

DATA FIELD OF GROUP CONTROL SYSTEM

| |
|---|
| COMMON INFORMATION TABLE |
| NO. 1 CAR PREDICTED ARRIVAL TIME TABLE |
| NO. 1 CAR DATA TABLE FOR ESTIMATION |
| ⋮ |
| NO. m CAR PREDICTED ARRIVAL TIME TABLE |
| NO. m CAR DATA TABLE FOR ESTIMATION |
| MONITOR TABLE OF GROUP CONTROLLER (1) |
| ⋮ |
| MONITOR TABLE OF GROUP CONTROLLER (m) |
| MISCELLANEOUS TABLES |

FIG. 10B

ELEVATOR STATUS TABLE OF NO. i CAR

| |
|---|
| CAGE POSITION TABLE |
| CAGE DESTINATION TABLE |
| CAGE WEIGHT TABLE |
| DOOR STATUS TABLE |
| CAGE - CALL REGISTRATION STATUS TABLE |
| |

FIG. 10C

RESPONSE CONTROL TABLE OF NO. i CAR

| |
|---|
| HALL-CALL ASSIGNMENT INSTRUCTION TABLE |
| DISTRIBUTION WAIT INSTRUCTION TABLE |
| SPECIFIC FLOOR RETURN INSTRUCTION TABLE |
| REFERENCE FLOOR FIRST CAR INSTRUCTION TABLE |
| |

FIG. 10D

COMMON INFORMATION TABLE

| |
|---|
| HALL-CALL REGISTRATION STATUS TABLE |
| TRAFFIC STATUS TABLE |
| ESTIMATION PARAMETER STATUS TABLE |
| |

FIG. 10E

APPARATUS FOR PERFORMING GROUP CONTROL ON ELEVATORS UTILIZING DISTRIBUTED CONTROL, AND METHOD OF CONTROLLING THE SAME

BACKGROUND OF THE INVENTION

1. Field of the Invention

The present invention relates to an apparatus for performing group control on a plurality of elevators which are operated for a plurality of floors and, more particularly, an improvement of a group management elevator system having a distributed control function.

2. Description of the Related Art

In recent years, in order to improve operation efficiency of a plurality of elevators installed parallel to each other and to offer better elevator services to passengers, the elevators are systematically controlled by a small computer such as a microcomputer to be quickly assigned to hall calls at respective floors. That is, when a hall call is made, an elevator car which allows optimum service is controlled to be selected and assigned to the hall call, and other elevator cars are controlled not to respond to this hall call.

In group control of this system, some advanced group control systems have a learning function. Interfloor traffic and average arrival time intervals between the halls can be managed in real time on the basis of measurements of cage-call registration data and passenger load data upon response to each hall call, as disclosed in, e.g., U.S. Pat. No. 4,760,896, "Apparatus for Performing Group Control on Elevators", patented to Yamaguchi on Aug. 2, 1988. The measurement data are processed by a computer in units of time zones to detect an elevator utilization demand of each building. Group control such as determination of an optimum car in response to a hall call, setting of a busy morning (opening) time zone, a lunchtime zone, and a busy evening (closing) time zone, setting of dispersed waiting zones of the elevator cars in non-busy hours, and setting of the number of halt elevator cars for energy saving.

A group control apparatus generally manages distributed control by a plurality of small computers. An elevator car unit control apparatus as a slave connected to the group control apparatus as a master is constituted by a small computer such as a microcomputer in a digital arrangement. High-speed information transmission is performed between the computer in the group control apparatus and the computer in the elevator car unit control apparatus via a serial transmission line or the like.

In the elevator system for performing group control, a ratio of control software utilized by the microcomputers to control hardware is high. Therefore, the overall system is complicated and digitized to perform high-speed information transmission between the computers.

Under these circumstances, a conventional group control apparatus is a centralized control system. In this centralized control system, the group control apparatus exchanges basic data with respective elevator car unit control apparatuses, and performs data processing in units of cars on the basis of the basic data.

When the scale of the group control elevator system is increased, i.e., when the numbers of floors and cars are increased, the computers in the group control apparatuses are overloaded. In this case, when the demand for hall calls is increased, the computer processing is affected by its capacity. For example, in a system having a reservation display function, the computer of the group control apparatus has a large load. A processing period running from the generation of a hall call to the time of an indicator-ON of an optimum car varies depending on the numbers of floors and elevator cars. The load on the computers in the total system is unbalanced. In addition, when a system-down occurs, the group control function fails at once. As a result, computer processing efficiency for the total system is poor.

Under the above circumstances, distributed control of control functions of an elevator system using multiple stations has been developed to aim at averaging of the load balance of control computers.

A system configuration of distributed control of the control functions is shown in FIG. 15A to 15C.

FIG. 15A shows a hierarchical system in which a group management slave controller for performing processing of each car unit is combined in a one-to-one correspondence with a unit controller for controlling a control function of the unit elevator. Each group management slave controller is connected in a slavemaster relationship to a group management master controller which is independently arranged to control the total system.

FIG. 15B shows a hierarchical system in which the function of the group management master controller of FIG. 15A is assigned to one of group management slave controllers for performing processing of elevator car units.

FIG. 15C shows a system in which the function of each unit controller and the function of the corresponding group controller are performed by one control computer.

In either system described above, processing of each elevator car unit has a one-to-one correspondence with the control computer. Load distribution is performed on the basis of the master control mechanism management. Therefore, the group management master function can be shifted between the slave controllers or systems.

However, the slave control function is not shifted. If a given slave controller fails, it is difficult to allow the remaining control computers to provide a cooperation function, i.e., an autonomous compensation function. For this reason, when a group management slave controller corresponding to a given unit controller fails, group control for the respective elevator is maintained except for the elevator car belonging to the failed group management slave controller. However, the failed elevator car is kept inactive or out of group control, thus degrading utilization efficiency.

In the systems shown in FIGS. 15A and 15B, in order to control n controllers, n (FIG. 15B) or (n+1) (FIG. 15A) computers are required. The control load is changed due to the number of floors of a building and/or the grades of the control systems, and fixed n or (n+1) distributed control systems are required. Cost performance is degraded against the purpose of load distribution. As a result, the flexibility and versatility of the system become poor.

In the system shown in FIG. 15C, all controllers are commonly arranged in the same computers as the unit controllers which must maintain absolute reliability as compared with the group control system. For this reason, a function of the unit controller having a higher priority is degraded by an influence of the group control system generally having a large control load. In addition, an elevator car unit corresponding to a control computer which failed due to a failure of the group control system also fails.

In the system of FIG. 15C, once a unit control system fails, the failure results in a decisive failure of the system. In addition, a unit control system fails upon a failure of the group control systems having an entirely different function from that of the unit control system, thus posing significant problems on reliability and safety. The group control system has limitations that its processing must be performed during interruption of processing of the unit control system having the higher priority. Therefore, the system in FIG. 15C has application limitations by the number of floors and/or the grades of the control systems.

In all the systems of FIGS. 15A, 15B and 15C, n computers (FIG. 15B) or (n+1) computers (FIG. 15A) are required, or no computer is required but the unit control function and the computer function are commonly provided (FIG. 15C). Although the distributed control systems are arranged to aim at load distribution, versatility of load distribution efficiency is limited by the number of floors and/or the grades of the control systems. That is, the above conventional systems are not satisfactory from the viewpoint of creation of a distributed control system having autonomous controllability/compensatability.

In a system for performing group control on elevators, control computers are used for group control and unit control. In order to average the loads of the respective control computers and perform highly efficient control, distributed control is proposed to distribute functions necessary for group control to a plurality of computers. Distributed control is advanced, and a one-to-one correspondence between elevator car unit processing and unit control is established. Therefore, the load can be distributed by the master control mechanism management base. Each unit control apparatus for controlling various operations of the elevator unit and each distributed control apparatus for performing distributed control for group control are separately provided in accordance with the processing capacity and unit control reliability which is of prime importance. These apparatuses are arranged in units of elevator car units. In order to control n elevators in the group, the load is changed by the number of floors and/or grades of the control systems. However, n distributed control systems are required to result in a wasteful system.

When one of the group control systems fails, the unit control system corresponding to the failed group control system cannot exchange data for group control. Therefore, this unit control system for the failed elevator car is considered out of control and removed from group control. Although group control of the total system is normally performed, overall utilization efficiency is degraded.

In a system wherein the unit control function and the group control function are assigned to each unit control computer in order to reduce the cost, when the group control system fails, the unit control system fails accordingly. Therefore, reliability of unit control is degraded.

SUMMARY OF THE INVENTION

It is an object of the present invention to provide an apparatus for performing group control on elevators and a method thereof, wherein a group control function is executed while compensation between control computers is established, reliability of unit control is maintained, system efficiency can be improved, and the system can be substantially free from an influence of a system load.

In order to achieve the above object of the present invention, the present invention is constituted as follows. A plurality of elevators are operated for a plurality of floors. Each elevator is evaluated by a predetermined calculation in response to a hall call. An optimum elevator is selected and the selected elevator is assigned to the hall call in accordance with the evaluation result. An apparatus for performing group control on elevators comprises the following means: (a) unit control means, arranged in units of elevator cars, for controlling unit control of each elevator car and inputting/outputting information associated with its own car; (b) a plurality of group control means each having a first process for exchanging each car information, a second process for determining a priority of its own by monitoring each active group control means and for scheduling load distribution and assignment of group control processes on the basis of the determined priority, a third process for performing evaluation calculations in units of cars for hall-call assignment on the basis of each car information, and a fourth process for instructing execution of the third process upon occurrence of a hall call, waiting an evaluation calculation result obtained by the execution of the third process, assigning an optimum car upon reception of the evaluation result from the third process, and generating an end instruction of the third process; and (c) communicating means for connecting the unit control means and the group control means to each other and between the group control means, and performing communication with each unit control means in a data field different from that for each group control means.

With the above arrangement, each group control means monitors other group control means to determine load assignment of its own so as to distribute the group control load. When a hall call is made, a given group control means serving as the fourth process instructs execution of the third process for the hall call to other group control means through the communicating means and waits for evaluation results. Upon reception of the evaluation results by the other group control means, the other group control means execute the third process, calculate evaluations for hall-call assignment in units of cars from information representing present status of each car, and transmit the calculation results through the communicating means. This transmission is performed from a control means having a relatively smaller load. Upon reception of the evaluation results, the given group control means serving as the fourth process performs assignment of the optimum car and generates an end instruction of the third processes. All group control means which are performing the third processes terminate execution of the third processes. In this manner, any group control means which has an available processing capacity for the control load executes necessary processes for group control. A group control means which has a heavy load may be exempt from process execution in practice, thereby averaging the load.

Since the communicating means communicates with each unit control means in a data field different from that for each group control means, the unit control means is not adversely affected by a failure of any group control means. For this reason, reliability of unit control can be improved. In addition, even if several group control means fail or are stopped, total group control is not adversely affected.

In order to achieve the above object of the present invention, the present invention can also be constituted as follows. There is provided an apparatus for performing group control on a plurality of elevators operated for a plurality of floors, evaluating each elevator b a predetermined calculation in response to a hall call, selecting an optimum elevator, and assigning the selected elevator to the hall call in accordance with the evaluation result, comprising: (i) unit control means, arranged in units of elevator cars, for controlling unit control of each elevator car and inputting/outputting information associated with its own car; (ii) a plurality of group control means each having a first process for exchanging each car information, a second process for determining a priority of its own by monitoring each active group control means and for scheduling load distribution and assignment of processes including car assignment so as to assign average loads of group control in correspondence with the number of active group control means and the priority on the basis of the determined priority, a third process for performing evaluation calculations for hall-call assignment on the basis of information of each car of process assignment upon reception of an instruction and for sending back the evaluation result to an instruction source, and a fourth process for instructing execution of the third process upon occurrence of a hall call, waiting an evaluation calculation result obtained by the execution of the third process, assigning an optimum car upon reception of the evaluation result from the third process, and generating an end instruction of the third process; and (iii) communicating means for connecting the unit control means and the group control means to each other and between the group control means, and performing communication with each unit control means in a data field different from that for each group control means.

With the above arrangement, each group control means monitors remaining group control means to detect its own priority and determines process assignment on its own side such that group control load assignment becomes average in correspondence with its own priority and the number of active group control means, the load assignment including car assignment. When a hall call is made, the group control means which detects the hall call first and has executed the fourth process instructs execution of the third processes for the hall call to all the group control means including itself, and waits for the evaluation results. Upon reception of the evaluation results by the group control means which detects the hall call first, the remaining group control means execute the third processes and perform evaluation calculations for hall-call assignment of their cars on the basis of the information of the cars assigned to these group control means. The evaluation results are sent from each group control means to all the group control means except for itself. Upon reception of the evaluation results for the respective cars, the group control means which performs the fourth process performs assignment of the optimum car and informs the assigned optimum car to the corresponding unit control means through the communicating means.

Each group control means is assigned with the process in accordance with the number of active group control means and its own priority. In addition, a given control means which performs a job (process) upon generation of a hall call causes other group control means to perform evaluation calculations, and performs optimal car assignment upon reception of the evaluation results. Therefore, the control loads are distributed to the respective group control means. In addition, each group control means monitors the remaining group control means to autonomously determine its own process, thereby distributing and averaging the load and hence averaging the control load. If even one of the group control means is operated, group control can be performed, thereby assuring reliability in this respect Furthermore, the communicating means communicates with each unit control means in a data field different from that for each group control means. Therefore, even if a given group control means fails, the unit control means is not adversely affected by data communication, thereby improving reliability of unit control.

BRIEF DESCRIPTION OF THE DRAWINGS

FIGS. 10A and 10B are data field information tables;

FIGS. 10C to 10E are tables shown in FIG. 10A and 10B;

DETAILED DESCRIPTION OF THE PREFERRED EMBODIMENTS

Figure 9:
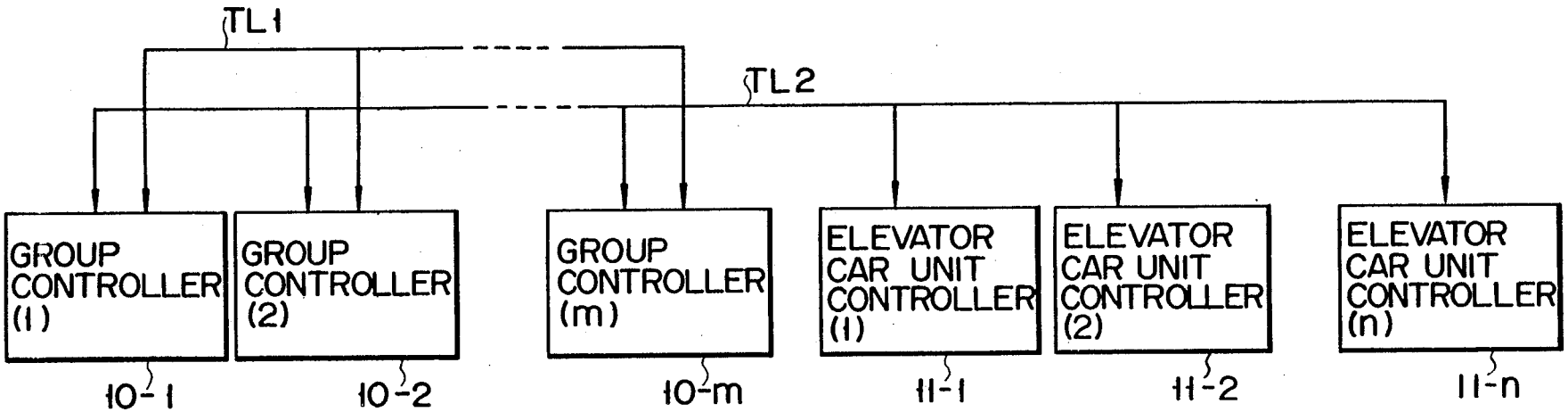
FIG. 9 is a system diagram of a communication data field according to the present invention.

Prior to a description of a preferred embodiment of the present invention, the basic concept of the present invention will be described with reference to FIG. 9. N elevator car unit controllers 11-*l* to 11-*n* for controlling a unit control function in a one-to-one correspondence with the elevator cars are connected to group controllers 10-*l* to 10-*m*, which control the group control function for performing scheduling management by active systems and which are determined by a system load, through high-speed transmission system TL1 having equal transmission/reception priorities. A group control function system (10-*l* to 10-*m*) is connected to a total system (10-*l* to 10-*m* and 11-*l* to 11-*n*) including the unit and group control functions through another high-speed transmission system TL2. These two hierarchical data fields (FIGS. 10A and 10B) are synthesized into one communication system.

m group controllers 10-*l* to 10-*m* are connected in parallel with each other through hall-call transmission system TL2 different from high-speed transmission system TL1. Respective group controllers 10-*l* to 10-*m* have functions for assigning scheduling control functions of the processes of the group control function to the corresponding computers. With this arrangement, each process is divided into the hall-call unit common management function and No. *l* to No. n car unit control functions. These divided functions are controlled by the operating system of each computer.

m group controllers 10-*l* to 10-*m* for controlling the group control function on-line monitor the number of active group control systems through the data field of the group control system. Respective group controllers 10-*l* to 10-*m* independently perfOrm scheduling of an event of the group control function by rechecking processing upon generation of a hall call or long waiting of a given hall call. Respective group controllers 10-*l* to 10-*m* are assigned with processes to allow load distribution in accordance with the number of active elevator cars.

Group controllers 10-*l* to 10-*m* execute their own assigned processes through the data field of the group control system in accordance with the divided process assignment upon generation of an event of hall-call assignment. The job (process) in units of hall calls is performed by a plurality of computers in a cooperative manner.

Unit controllers 11-*l* to 11-n arranged in a one-to-one correspondence with the elevator cars autonomously perform inputs/outputs through the total system data field asynchronous with the group control system data field Respective unit controllers 11-*l* to 11-*n* select information of their own cars for a hall call in accordance with information of each responded car determined by the group control system (10-*l* to 10-*m*) and on the above data field, and perform their own unit control functions by using the selected information as hall-call control information.

As described above, the hall-call unit group control function for each hall call is divided into (n+1) rearrangeable control processes by the n controllers (11-*l* to 11-*n*), and the loads are assigned to the m group control systems (10-*l* to 10-*m*) in accordance with their active/inactive states. A series of group control functions can be realized by the data input/output with respect to the data field of the group control system (10-*l* to 10-*m*). Unit designation information mainly including the hall-call response information determined by the group control function is supplied to respective unit controllers 11-*l* to 11-*n* through the data field of the total system. The unit control systems (11-*l* to 11-*n*) can perform their own control functions through the data field which is a single transmission system but has a hierarchical structure. This operation is performed without being influenced by the loads of the group control system (10-*l* to 10-*m*).

The group control systems can perform assignment of the respective process loads in accordance with the active/inactive states of m group controllers 10-*l* to 10-*m*. Therefore, high-reliability and high system efficiency can be achieved, and cooperative distributed control between the computers of the group controllers can be achieved.

N elevator car unit controllers 11-*l* to 11-*n* for controlling a unit control function in a one-to-one correspondence with the elevator cars are connected to group controllers 10-*l* to 10-*m*, which control the group control function for performing scheduling management by active systems and which are determined by a system load, through high-speed transmission system TL1 having a given transmission/reception priority. A group control function system (10-*l* to 10-*m*) is connected to a total system (10-*l* to 10-*m* and 11-*l* to 11-*n*) including the unit and group control functions through another high-speed transmission system TL2. These two hierarchical data fields (FIGS. 10A and 10B) are synthesized into one communication system.

Group controllers 10-*l* to 10-*m* are connected in parallel with each other through hall-call transmission system TL2 different from high-speed transmission system TL1. The group control function is divided into processes of n elevator car unit group control functions. Respective controllers 10-*l* to 10-*m* autonomously determine process assignment by the scheduling control function. Controllers 10-*l* to 10-*m* are managed by the operating systems of the computers, so that these controllers 10-*l* to 10-*m* autonomously determine a response to a hall call in a cooperative manner.

In the same manner as in the nm (n+1) systems, m group controllers 10-*l* to 10-*m* for controlling the group control function on-line monitor the number of active group control systems through the data field of the group control system. Respective group controllers 10-*l* to 10-*m* independently perform scheduling of an event of the group control function by rechecking processing upon generation of a hall call or long waiting of a given hall call. Respective group controllers 10-*l* to 10-*m* are assigned with processes to allow load distribution in accordance with the number of active elevator cars.

The group control function for each hall call is divided into control processes which can be rearranged into n systems by n elevators, and the loads are assigned to the m group control systems (10-*l* to 10-*m*) in accordance with their active/inactive states. A series of group control functions can be realized by the data input/output with respect to the data field of the group control system (10-*l* to 10-*m*). Unit designation information mainly including the hall-call response information determined by the group control function is supplied to respective unit controllers 11-*l* to 11-*n* through the data field of the total system. The unit control systems (11-*l* to 11-*n*) can perform their own control functions through the data field which is a single transmission system but has a hierarchical structure. This operation is performed without being influenced by the loads of the group control system (10-*l* to 10-*m*).

The group control systems can perform assignment of the respective process loads in accordance with the active/inactive states of m group controllers 10-*l* to 10-*m*. Therefore, high-reliability and high system efficiency can be achieved, and cooperative distributed control between the computers of the group controllers can be achieved.

Figure 1:
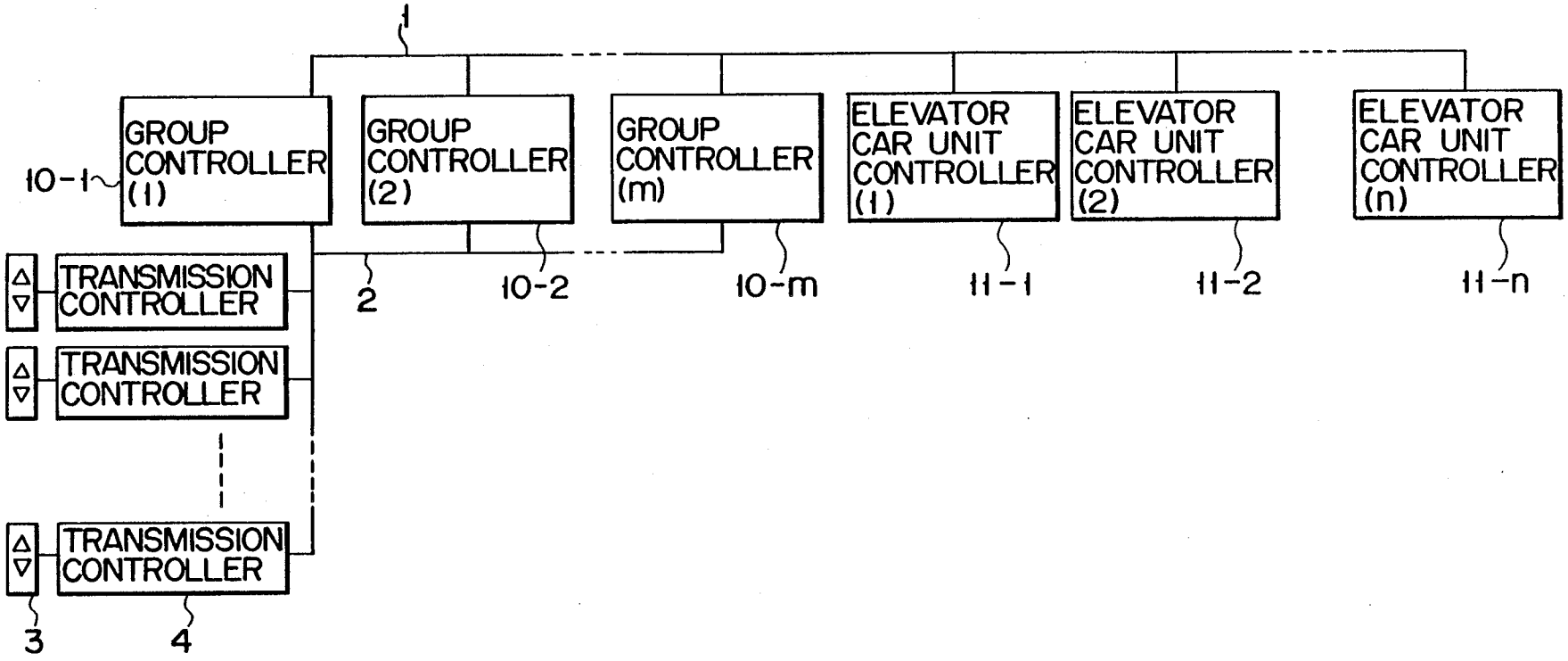
FIG. 1 is a block diagram showing an elevator system configuration according to the present invention.

An embodiment of the present invention using n elevators will be described with reference to the accompanying drawings. FIG. 1 is a block diagram showing a system for performing group control on n elevators.

Referring to FIG. 1, reference numerals 10-*l* to 10-*m* denote m group controllers which are subjected to distributed control. Reference numerals 11-*l* to 11-*n* denote n elevator car unit controllers arranged in a one-to-one correspondence with the elevator cars to control operation control functions of the elevator car units. These controllers are constituted by high-performance small computers such as microcomputers and are operated under management of software stored in each controller.

Group controllers 10-*l* to 10-*m* and elevator car unit controllers 11-*l* to 11-*n* are connected to high-speed transmission system 1 for obtaining an equal transmission/reception priorities. The respective controllers (10-*l* to 10-*m* and 11-*l* to 11-*n*) can communicate with each other through this transmission system 1. The data fields of two systems each having a hierarchical structure described above are formed on high-speed transmission system 1. The group control functions mainly including the hall-call assignment function are performed by cooperation between the controllers (10-*l* to 10-*m* and 11-*l* to 11-*n*) by using the group control system (10-*l* to 10-*m*) data field and the total system (10-*l* to 10-*m* and 11-*l* to 11-*n*) data field including group management and unit controllers.

Low-speed transmission system 2 is a transmission control system for transmitting information transmitted through an elevator path such as call button 3 on each hall and can have a transmission speed lower than that of high-speed transmission system 1 because the volume of data communication on transmission system 2 is limited. Transmission system 2 is connected in parallel with group controllers 10-*l* to 10-*m* for controlling hall calls. Group controllers 10-*l* to 10-*m* can perform equal input-/output management of hall-call information through system 2.

Figure 2A:
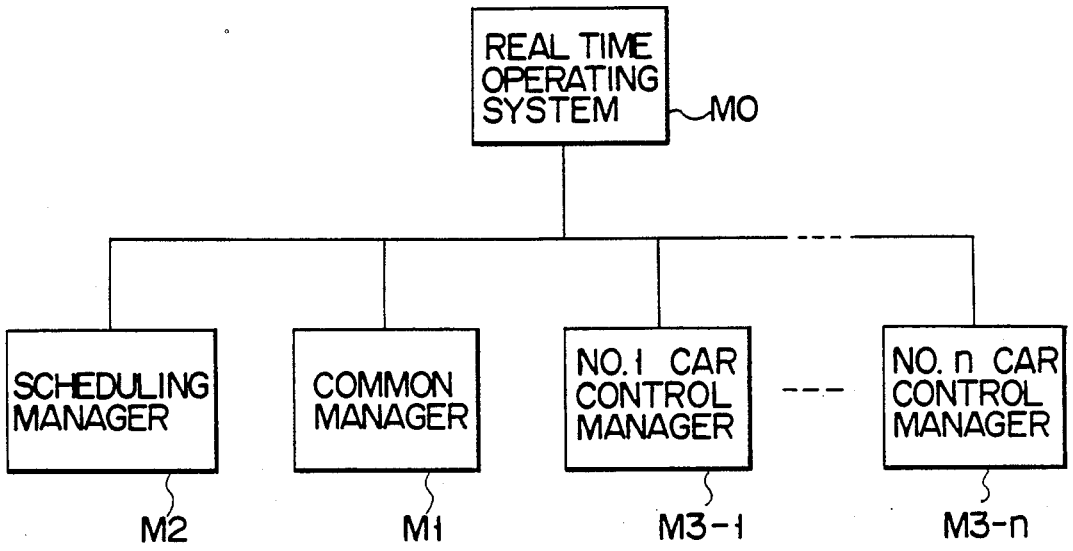
FIGS. 2A and 2B are views showing software of a group controller according to the present invention.

FIG. 2A is a system configuration showing an embodiment of a software system having group controllers 10-*l* to 10-*m* according to the present invention.

As shown in FIG. 2A, each of m group controllers 10-*l* to 10-*m* for controlling the group control function comprises (n+1) processes consisting of common manager M1 having a hall-call unit sync control function, and n car control managers M3-*l* to M3-*n* having car control functions. With this arrangement, each job having a hall-call assignment function in units of hall calls is performed for n group controllers.

The (n+1) processes perform process assignment for m group controllers 10-*l* to 10-*m* shown in FIG. 1 by scheduling manager M2 so that the load processes of the group control system are equally assigned to the (n+1) systems.

Scheduling manager M2 has an arrangement for on-line monitoring the active group control systems by group control system data fields (to be described later with reference to FIGS. 10A and 10B) through high-speed transmission system 1. Scheduling manager M2 has a function for automatically performing optimum load distribution of the instantaneously changing hall-call assignment job in the present status in real time.

No. *l* to No. n car control managers M3-*l* to M3-*n* share one processing algorithm but have independent control areas in units of cars. This algorithm has processes registered as independent tasks in real time operating system M0.

Common manager M1 having the hall-call sync control function primarily has a control function for performing sync control of the processes of group controllers 10-*l* to 10-*m* which are distributed into m systems. Common manager M1 has an arrangement which can support message reception queues from a plurality of sources and satisfies basic interprocess sync support functions such as a time-out function by time management and a retry request by an NAC (Negative Acknowledge Character) response. The contents of the algorithms used in units of hall calls are identical but have independent control areas. These algorithms are processes which can independently manage hall-call and recheck jobs which are simultaneously requested.

Figure 3:
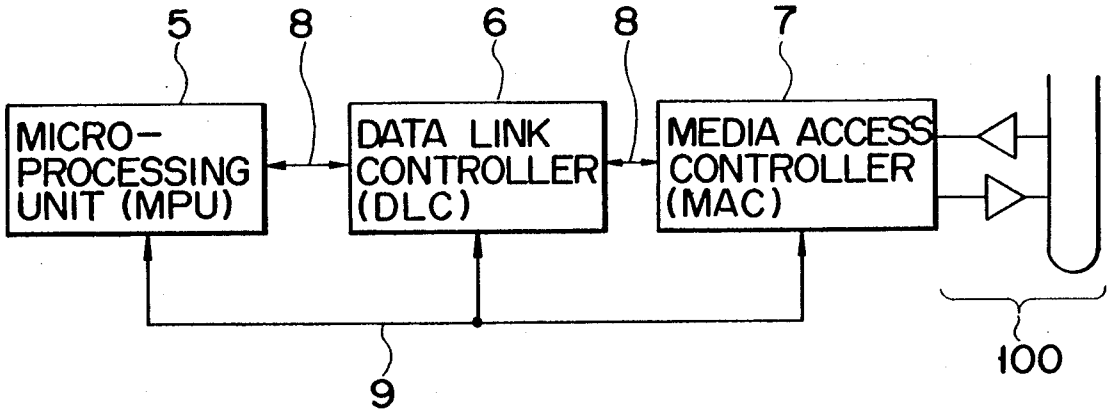
FIG. 3 is a block diagram showing a hardware configuration of a high-speed transmission system according to the present invention.

FIG. 3 is a block diagram showing a hardware system configuration of high-speed transmission system 1 in FIG. 1. Transmission control is performed using microprocessing unit (MPU) 5. An arrangement for controlling a data link hierarchical structure complying with a LAN network model hierarchical structure proposed by the ISO (International Standards Organization) is constituted by data link controller (DLC) 6 and media access controller (MAC) 7, both of which are hardware arrangements. Therefore, highly intelligent data transmission can be performed, and a transmission control software load managed by microprocessing unit 5 for high-speed transmission control can be reduced.

For example, an LSI i82586 available from INTEL Corp., U.S.A. can be used as data link controller 6 as a controller for performing highly intelligent transmission control. An i*82501* available from INTEL Corp., U.S.A. can be used as the media access controller. By using these LSIs, high-speed transmission at a rate of 10Mbps can be relatively easily performed while the load of microprocessing unit 5 can be reduced. Reference numeral 9 denotes a system bus; 8, a control line; and 100, a serial transmission system connected to transmission system 1.

The operation of the transmission control system for performing interprocess communication between the controllers will be described with reference to FIGS. 4 to 9.

Figure 4:
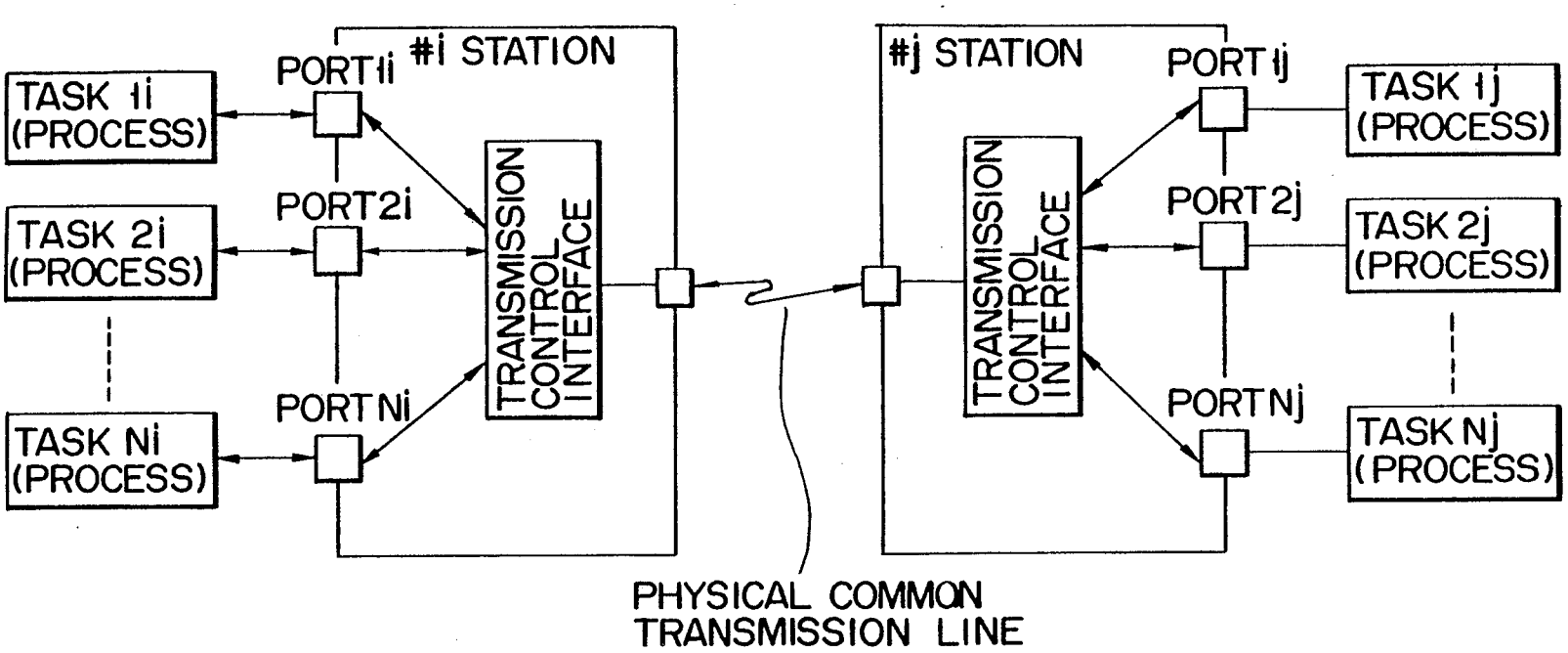
FIG. 4 is a block diagram showing a system configuration of a logical communication line of a transmission system according to the present invention.
Figure 5:
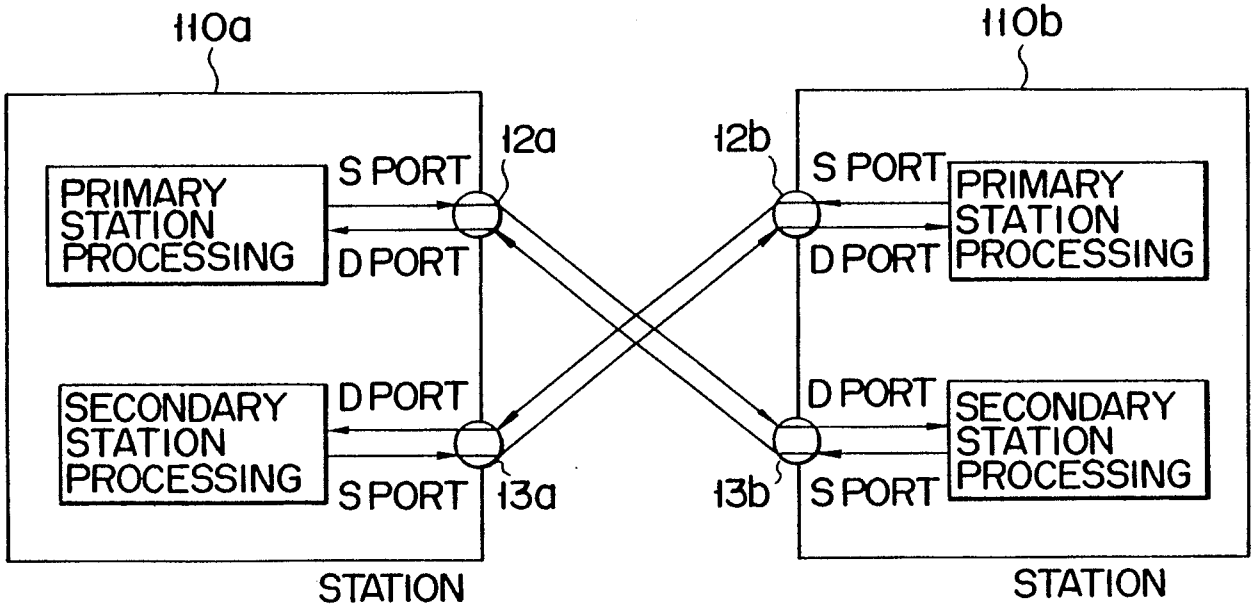
FIG. 5 is a system diagram showing connection between logical transmission lines.

FIG. 4 is a block diagram showing a system of a theoretical transmission line in high-speed transmission system 1 in FIG. 1. FIG. 5 is a system diagram showing theoretical transmission connections between ports in FIG. 4.

Figure 6:
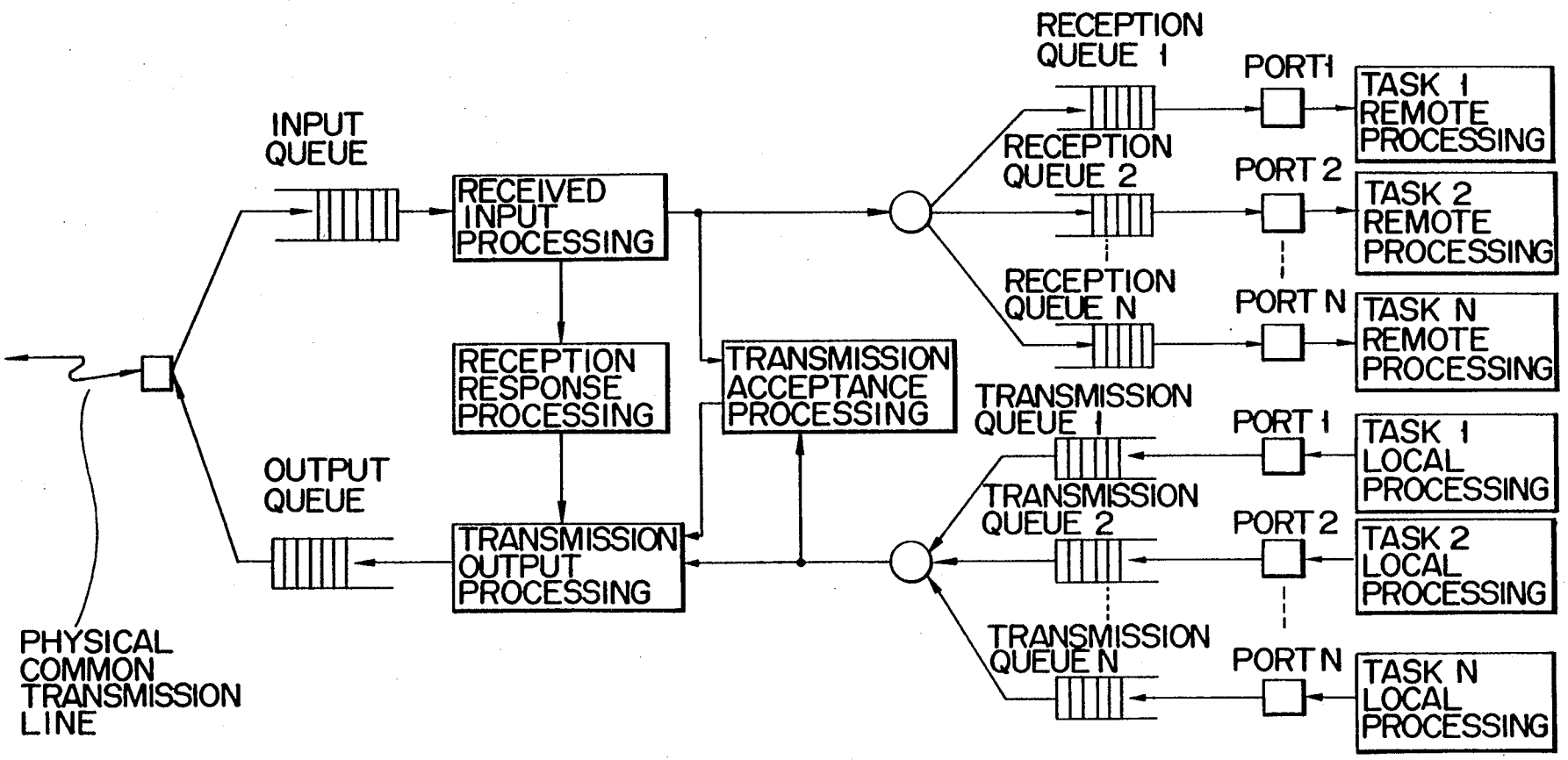
FIG. 6 is a block diagram for explaining a control operation of a transmission control system according to the present invention.
Figure 7:
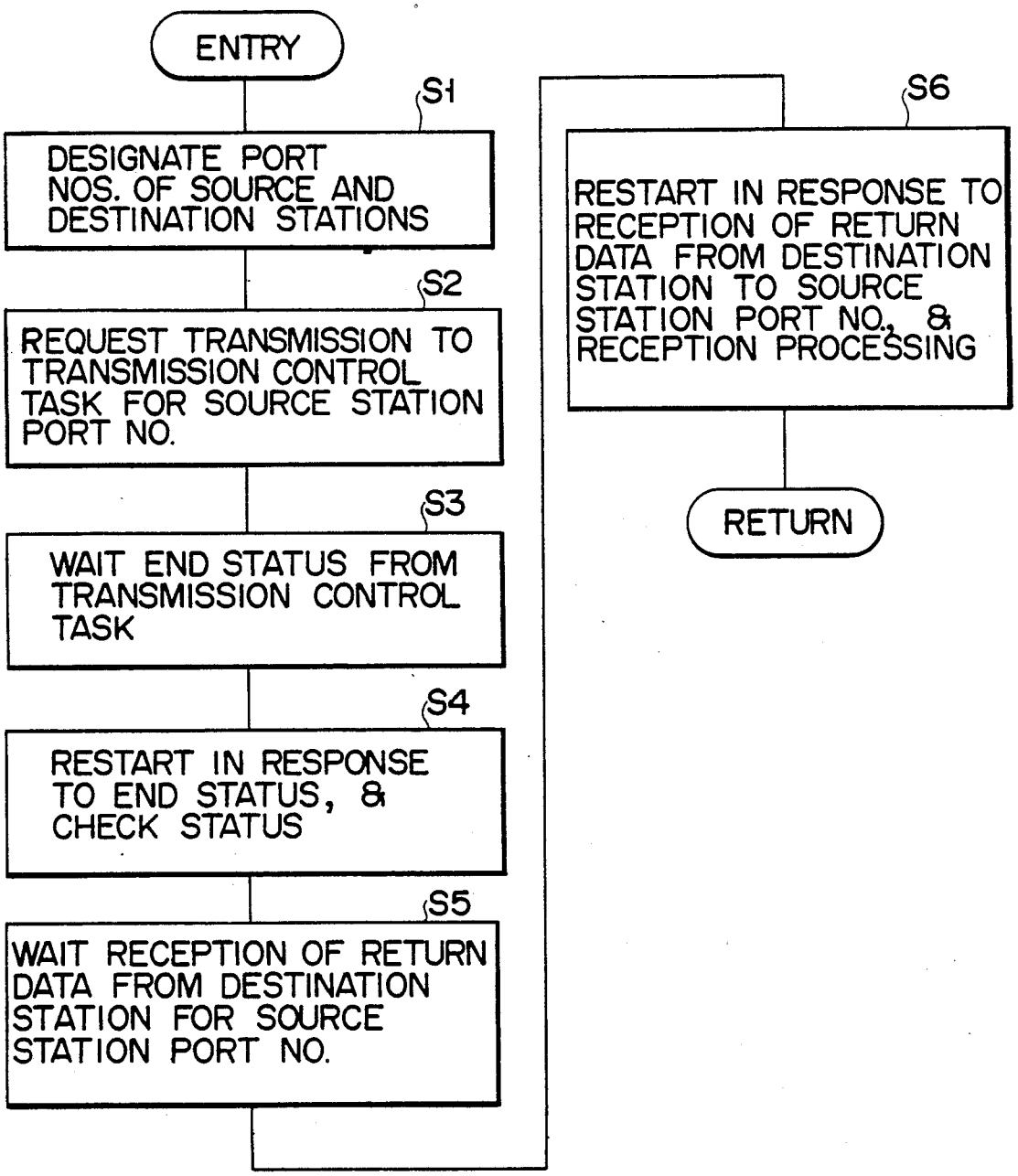
FIGS. 7 and 8 are flow charts showing detailed operations of primary station function processing and secondary station function processing in communication between tasks according to the present invention, respectively.
Figure 8:
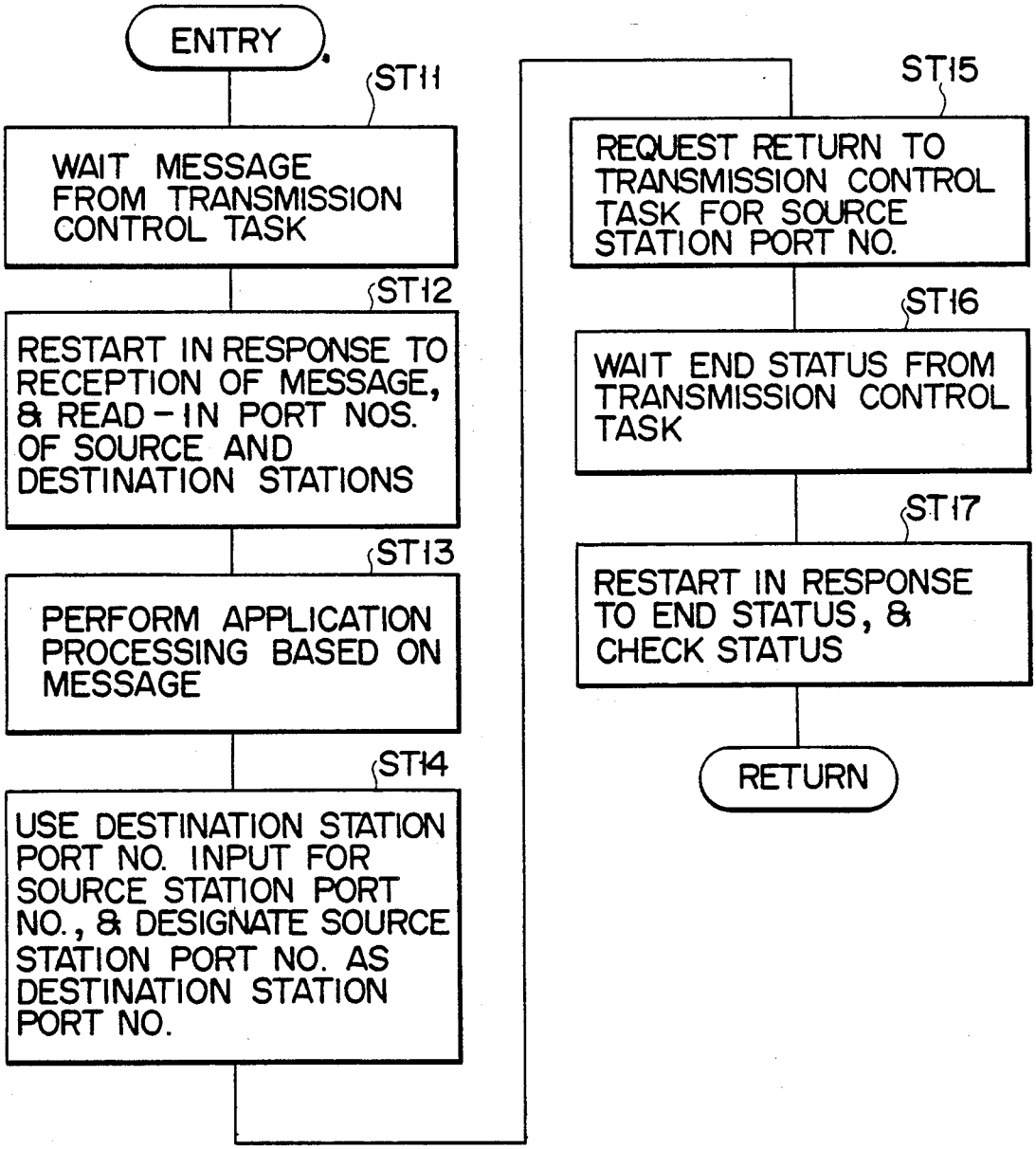

FIG. 6 is a view showing an operation of a transmission control system shown in FIGS. 4 and 5. FIGS. 7 and 8 are flow charts showing detailed operations of primary station processing and secondary station processing in interprocess communication of user tasks.

As shown in the system block of FIG. 4, N logical transmission lines are assumed on a physical common transmission line. The tasks in each station communicate with those in another station through N ports respectively set for the logical communication lines. Therefore, although physical communication line PL which connect the stations is constituted by one system, each station can perform parallel processing corresponding to the number of ports, i.e., N tasks if the number of ports is N. In this case, the operations of the transmission/reception queues of the tasks can be independently managed.

The transmission/reception operations from the respective task are shown in FIG. 6. A transmission queue requested as a queue signal by a local processing function as a primary station function of each task is formed by a transmission control management table in units of port numbers.

In a remote processing function as a secondary station function, a reception queue as a reception request is controlled and formed by each transmission control management table. A transmission output to physical common transmission line PL and an input received from physical common transmission line PL are temporarily buffered as transmission packets in the form of input and output queues. This buffering is managed by the transmission controller. Transmission/reception control with respect to physical common transmission line PL is performed without control of the CPU.

A detailed operation of intertask communication will be described in detail with reference to FIGS. 7 and 8.

In the primary station function task for performing a transmission request, ports of a transmission source are set for a transmission control task. Port Nos. SPORT and DPORT of the source and destination sources are designated. Primary station processing in station 110*a* corresponds to the operation shown in FIG. 7. The source station port No. corresponds to transmission port 12*a*, and the destination station port No. corresponds to reception port 13*b*.

More specifically, when the primary station function task is executed in FIG. 7, the port Nos. of source and destination stations SPORT and DPORT are designated (S1), and transmission to the transmission control task for source station port 12*a* is requested (S2). When the transmission is requested, the transmission queue of the corresponding source station port No. in FIG. 6 is queued. Transmission output processing is executed by the transmission queue to form a transmission packet, and the transmission packet causes queueing of the output queue. The transmission packet is under the management of the transmission controller. Therefore, the primary station processing task waits an end status from the transmission control task (S3). The present task is temporarily interrupted, and control is shifted to the OS scheduler. If another task for a transmission request is present and this task has an occupying right of the CPU, the right is shifted to this task.

The transmission packet is sent onto physical common transmission line PL by the transmission controller having management upon queueing. Thereafter, when the end status is set by the transmission control task, the present task is restarted and checks the status (S4). The present task waits reception of return data from the designation station for the source station port No. (S5). When the transmission packet is output onto the physical common transmission line, reception processing is executed in the designation station (S6).

FIG. 8 shows secondary station processing corresponding to the primary station processing shown in FIG. 7. This secondary station processing corresponds to that of station 110*b* in FIG. 5.

A logical transmission line is connected at reception port 12*b* corresponding to the destination station port No. DPORT. The operation of the transmission packet is shown in FIG. 6. When the transmission packet is received through physical common transmission line PL, the packet is queued as an input queue. The source and destination port Nos. are read by the transmission control task via received input processing. The read value is queued as a reception queue corresponding to the corresponding port No. DPORT, thereby connecting primary station processing to secondary station processing.

In this secondary station processing, the station waits a message from the transmission control task (ST11). Secondary station processing is started in response to reception of the message and reads in the source and destination station port Nos. (ST12). Message data is decoded and application processing is performed based on the decoded message (ST13). Thereafter, the DPORT as the destination station port No. at the time of data input is used as a source station port No., and the source station port No. at the time of data input is used as the destination station port No. (ST14). A packet is sent to the transmission control task to request return transmission to the transmission control task (ST15). This transmission flow corresponds to return transmission from reception port PORT 13*b* to transmission port PORT 12*a* in FIG. 5. This operation indicates that return transmission is performed by the port No. received by the secondary station for the port No. sent from the primary station.

The task waits an end status from the transmission control task (ST16). The task is restarted in response to an end status and checks a status (ST17), thereby completing secondary station processing.

A return transmission packet is output by an output queue in secondary station processing of secondary station 110*b* and is received in primary station processing of primary station 110*a*. When the received packet is queued into the input queue, transmission port 12*a* of primary station 110*a* is designated by the secondary station at the time of return transmission. For this reason, this return transmission is input to the port corresponding to transmission port 12*a*. The return transmission input port coincides with a source port at which the primary station task is set in the wait status. The primary station processing task which waits return data from the destination station to source port 12*a* is restarted. Received data input and processing are performed, and primary station processing is completed.

When the source and destination station port Nos. are designated at the time of data transmission from the source side, primary station processing is correlated to secondary station processing between the controllers. Therefore, the controllers are connected through theoretical or logical communication lines, and intertask communication through the logical communication lines can be realized. Although physical transmission line PL is one, a plurality of logical transmission lines can be set on physical common transmission line PL. Therefore, high-speed transmission (10 Mbps) can be performed. When a plurality of tasks shown in FIGS. 7 and 8 are present and simultaneously performed, parallel intertask communication can be performed in real time independently of tasks at other ports. That is, a queue as in the case of a single port is not generated. Parallel intertask communication can be performed to achieve high-speed communication.

An operation of a group management distributed control system having an autonomous function through a high-speed transmission system capable of supporting interprocess communication will be described below.

FIGS. 9 and 10A to 10E show a broadcast communication system of a data field having a hierarchical structure created in high-speed transmission system 1, and information data thereof. Group controllers 10-*l* to 10-*m* form an m-system group control data field (FIG. 10B) for performing a group control function whose scheduling can be managed by active systems and a total system data field (FIG. 10A) also including a unit control function on the high-speed common transmission system which can be managed by a plurality of logical transmission lines.

Group controllers 10-*l* to 10-*m* have an arrangement for input/output-accessing the two-system (TL1 and TL2) data fields Elevator car unit controllers 11-*l* to 11-*n* are not assigned with processes of the group control function. For this reason, elevator car unit controllers 11-*l* to 11-*n* perform input/output access of only the limited data fields of response assignment information obtained as a result of process scheduling function of the m group controllers 10-*l* to 10-*m* and information of each car serving as base data of the car unit control process.

The data fields are shown in FIGS. 10A and 10B. FIG. 10A shows a total system data field, and FIG. 10B shows a group control system data field.

As described above, the total system data field (FIG. 10A) is limited to the response assignment information and car information required in units of cars. Therefore, the elevator car unit controllers a system-down of which is decisive and which are normally required large-capacity communication for distributed control require a minimum volume of data communication. The minimum volume of data communication and distributed processing can eliminate local overloading caused by group control function which tends to cause a complicated, heavy computer load. Therefore, reliability of the elevator car controllers can be improved.

Elevator status information of n elevators of n groups are sent on the total system data field (FIG. 10A). Elevator car unit controllers 11-*l* to 11-n for controlling the car unit control processes have equal assignment rights for m group controllers 10-*l* to 10-*m*.

The group control system data field is divided into fields of common information (i), n-system car control management information (ii), and m-system group control management information (iii). The fields of information (i) and the information (ii) serve as fields exchanged by (n+1) control processes for an event of a hall call. The field of group control management information (iii) is a field used for scheduling management for averaging and assigning the plurality of processes for hall-call assignment jogs to the controllers.

FIG. 10C shows an elevator status table of No. i ($1 \geqq i \geqq n$) car in the data field of FIG. 10A. This table includes a cage position table showing the cage position of No. i car, a cage destination table representing a traveling direction of the cage, a cage weight table representing a load of the cage. a door status table representing whether the door of this cage is open or closed, and a cage-call registration status table representing whether a cage call is made and the floor at which the cage call is made if it is detected.

FIG. 10D shows a response control table of No. i car in the data field of FIG. 10A. This table includes a hall-call assignment instruction table for instructing assignment of No. i car to a specific floor when the No. i car is determined to be responded to the generated hall call, and for indicating the condition of a hall call to which the assignment has been completed; a distribution wait instruction table for instructing a wait when a condition for performing the distribution wait is established; a specific floor return instruction table for storing instructions required for returning the cage to a specific floor; and a reference floor forerunner instruction table for storing instructions for determining which cage is a forerunner when a plurality of cages wait at the reference floor such as a first-floor lobby.

FIG. 10E shows a common information table in the data field shown in FIG. 10B. This table includes a hall-call registration status table which represents hall-call registration status, a traffic status table representing a flow of traffic (flow of trafic demand) of whole elevator system, and an estimation parameter status table representing a control parameter status of estimation operation (to be described later with reference to FIG. 14).

A No. m car data table for estimation, a No. m car predicted arrival time table, and the like of the data field shown in FIG. 10B are disclosed in the following U.S. patent together with evaluation calculations:

U.S. Pat. No. 4,760,896 patented on Aug. 2, 1989, titled "Apparatus for Performing Group Control on Elevators" invented by Yamaguchi. All disclosed contents of this U.S. patent are incorporated in the specification of the present application.

The arrangements of FIGS. 3 to 6 of the present application are also disclosed in U.S.S.N. 101,135 filed on Sept. 25, 1987, titled "Information Transmission Control Apparatus for Elevator System" invented by the present inventor. All disclosed contents of this U.S. application are also incorporated in the specification of the present application.

Figure 11:
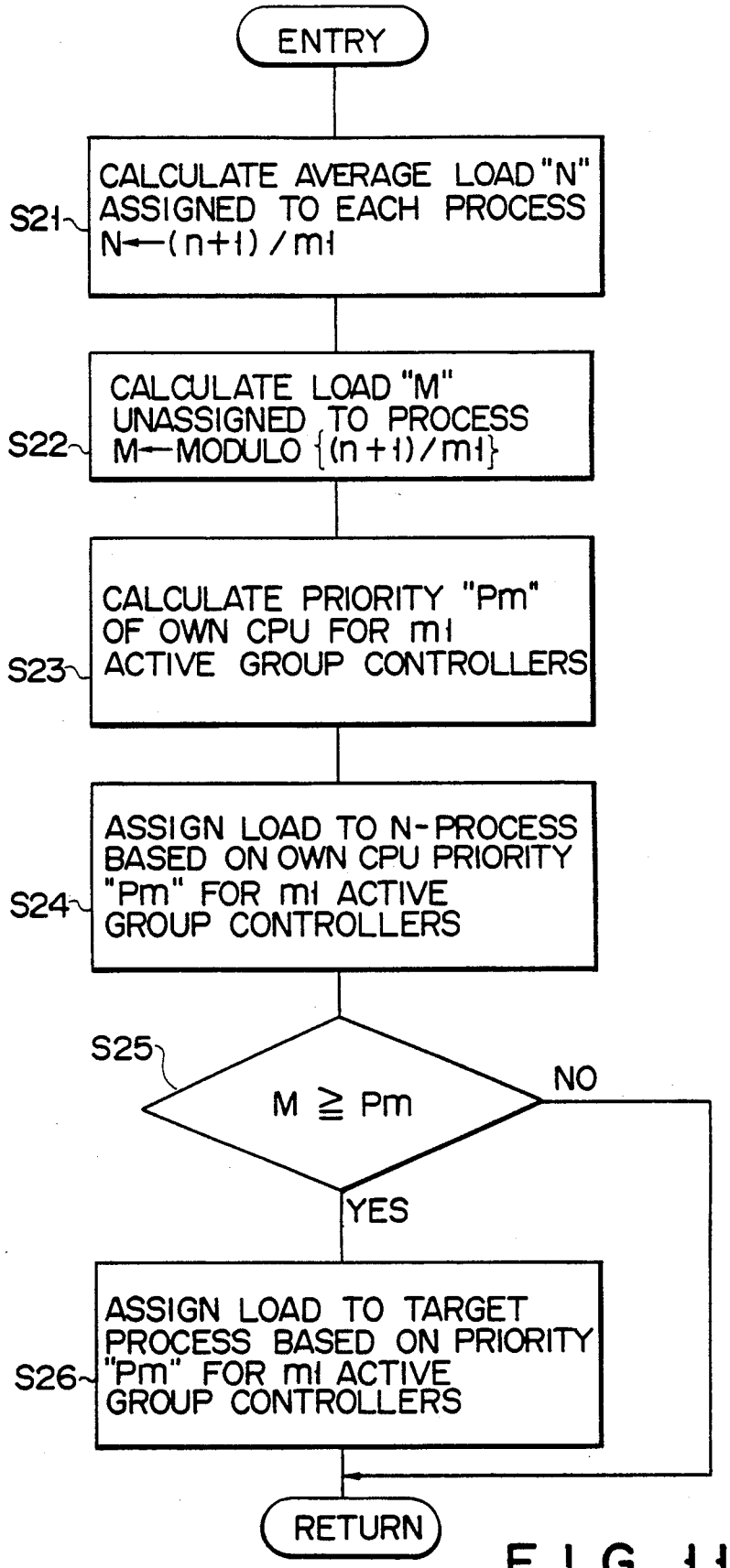
FIG. 11 is a flow chart showing scheduling management in the arrangement of FIG. 2A.
Figure 12:
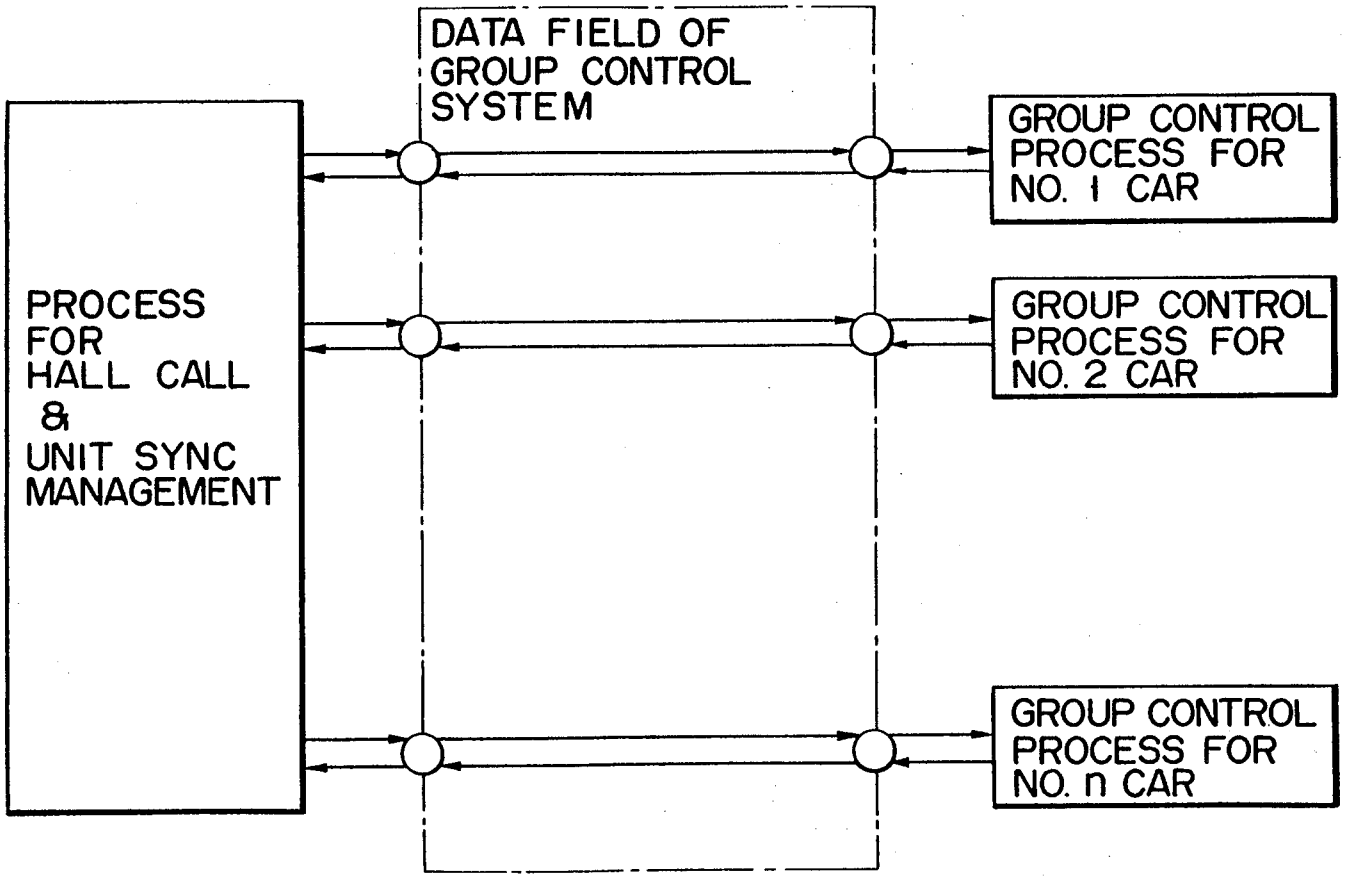
FIG. 12 is a view for explaining an operation between control processes in the arrangement of FIG. 2A.
Figure 13:
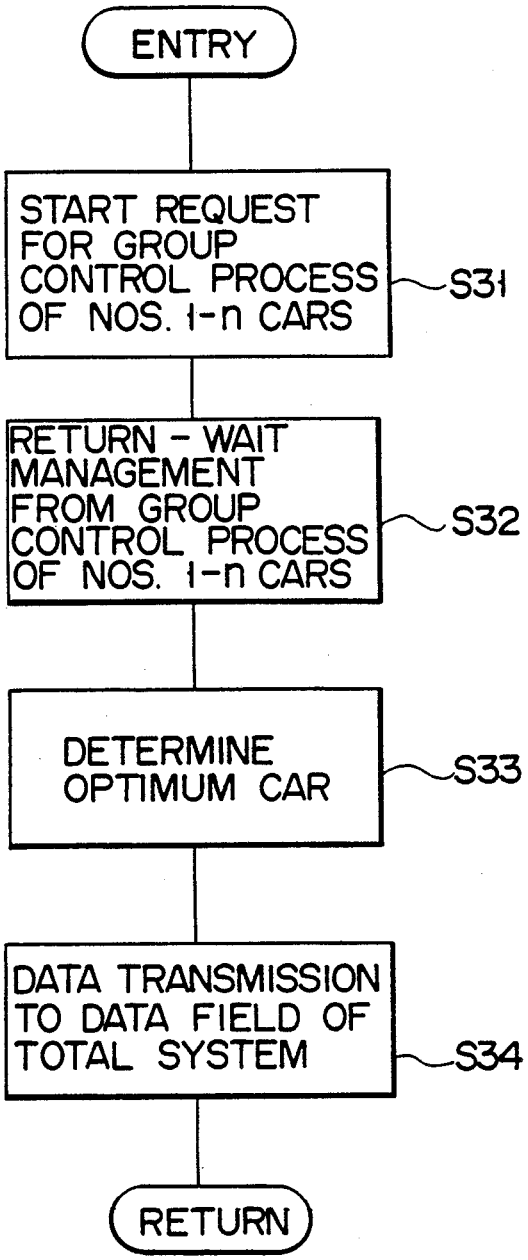
FIG. 13 is a flow chart showing a process operation of sync control in the arrangement of FIG. 2A.
Figure 14:
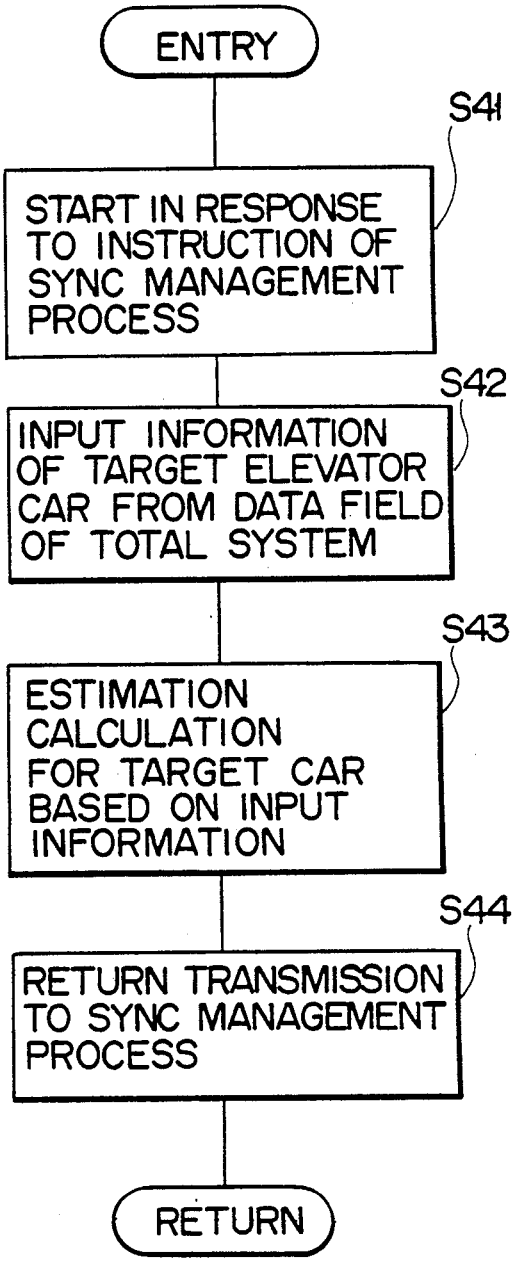
FIG. 14 is a flow chart showing a process operation in car control in the arrangement in FIG. 2A.
Figure 15A:
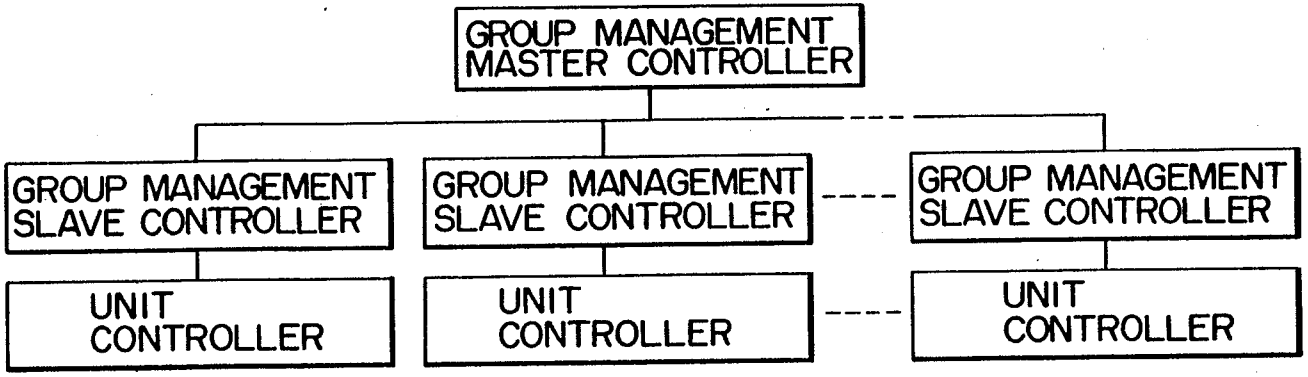
FIGS. 15A, 15B, and 15C are block diagrams showing arrangements without employing the present invention.
Figure 15B:
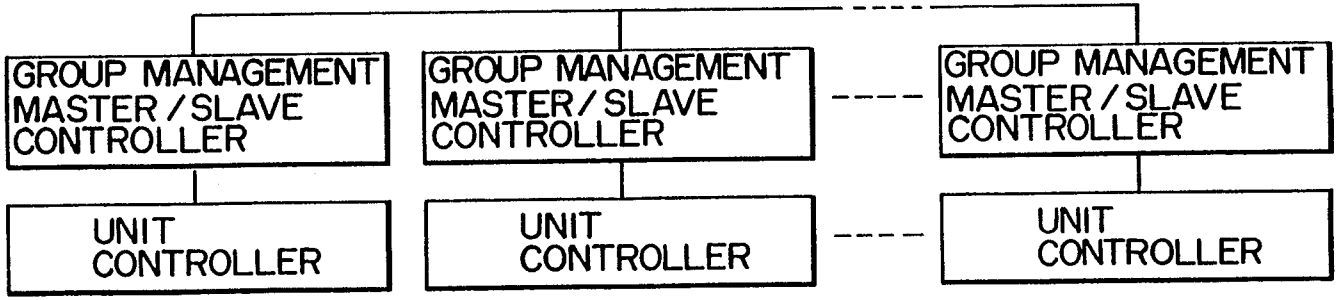
Figure 15C:
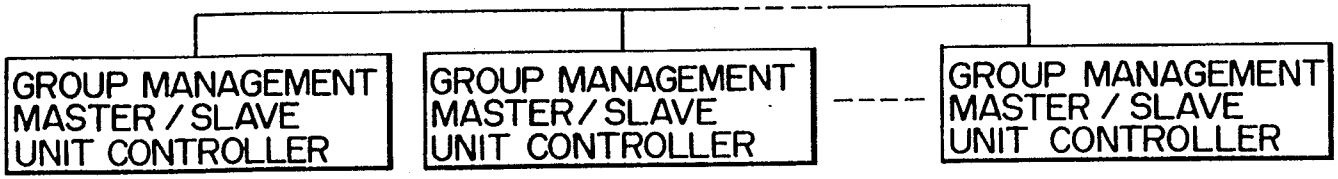

FIG. 11 is a flow chart showing a scheduling control operation of the arrangement in FIG. 2A. FIG. 12 is a view showing an interprocess control operation of (n+1) divided processes after scheduling management is completed and the respective processes are assigned. FIG. 13 is a flow chart showing an operation of a hall-call unit sync control function as one of a plurality of processes of the present invention, and FIG. 14 is a flow chart showing an operation of a car control function as another one of the plurality of processes of the present invention.

As shown in the flow chart of FIG. 11, m group controllers 10-*l* to 10-*m* perform on-line load assignment of (n+1) processes in real time. In order to execute load division, the number of active systems (e.g., 5 systems) out of m systems (e.g., 8 systems) is monitored by monitoring the data field (FIG. 10B) of the group control systems to calculate number m1 of control systems to which the group control functions are assigned. Average load $N = (n+1)/m1$ assigned to (n+1) control processes of the hall-call unit sync control management process and No. 1 to No. n car control management processes which are obtained by dividing the hall-call assignment control function into the plurality of processes is calculated (S21). For example, if $n=8$ and $m1=5$, $N=9/5=\frac{1}{8}$. A fractional part is rounded off to obtain $N=1$.

Unassigned load M of the process which is represented by a remainder of the division of $(n+1)/m1$ is calculated (S22). For example, if $n=8$ and $m1=5$, the remainder of $(n+1)m1$ is given as 4. Priorities Pm of the group controllers ($m1=1$ to 5) determined to be active by the above monitoring in units of their own system numbers (e.g., 1, 2, 3, 4, and 5) in 1 to m group controllers **10-*l* to 10-*m* are calculated (S23). The priority is determined solely when the loads on the hall-call unit sync control process and the No. 1 to No. n car control processes are equal to each other. The control processes (5 processes) as the average load processes are assigned to m active group controllers m1 (=5) in accordance with their own CPU priorities Pm (S24**). For example, if one average load process has one point, one point is assigned to each of the five active systems.

The number m of systems is not fixed to a predetermined value and all the m systems are not always normally operated. For these reasons, all process assignment is not always completed by assignment of processes to m1 (=5) systems.

The unassigned M (4 systems) load processes are compared with calculated priority Pm of the own CPU. If a process to be assigned to each of the M systems is present (i.e., if YES in step S25), the unassigned process (one point) is assigned in addition to the average load (one point) to the corresponding one of the M systems in the same manner as in the assignment algorithm (S21) of the average load algorithm (S26).

For example, assume that a group control of five systems (m1 =5) for the eight (n =8) elevators is in active, and that higher priorities are assigned to the system having smaller numbers. Each average load assigned to No. 1 to No. 5 systems is given as one point (S21). In this case, unassigned processes are given as 4 points (M =4) (S22). These unassigned processes are additionally assigned to No. 1 to No. 4 systems, respectively, in accordance with their priorities. In this case, the load processes assigned to each of No. 1 to No. 4 systems are two points, while the load process assigned to No. 5 system is kept to be one point. In this manner, load distribution in group control is automatically performed.

That is, the (n+1) control processes for each hall call are assigned to m group controllers in accordance with their degrees of operations.

According to the scheduling management of the algorithm shown in the flow of FIG. 11, since no predetermined relationship is established between the m group controllers and n elevators, the number of systems can be arbitrarily set in accordance with the number of floors, the grades of elevator models, and a total system load of the group controllers. In addition, if at least one of the m systems is operated, a total function can be normally performed.

The (n+1) processes assigned to the m1 active systems by the above scheduling management are controlled in units of hall calls. In an event of generation of a hall call or rechecking caused by long-period waiting, a series of processes are correlated through the group control system data field while process control is synchronized by the hall-call unit sync management process, as shown in FIG. 12. The group control function as hall-call assignment is systematically performed in the m1 group controllers.

Start management of a hall-call assignment job is performed by a sync management process flow chart in FIG. 13. Process starting of the controllers to which No. 1 to No. n car unit processes are assigned is performed through the group control system data field.

A request for the group control process of Nos. 1 to n cars is started (S31), and management from the group control process of Nos. 1 to n cars is return-waited (S32).

The group control process of each car which is started by the start request in step S31 is performed by process processing in accordance with the flow chart in FIG. 14. Starting is performed in response to an instruction of sync management process (S41). Information of the target elevator car is input from the data field (FIG. 10A) of the total system (S42). An estimation calculation is performed for the target car based on the input information (S43). The result is returned to the sync management process (S44).

Upon reception return transmission, the sync management process (FIG. 13) determines an optimum car to which the response is assigned on the basis of the evaluation result (S33). At the same time, process end management is executed for all group control processes. After synchronization is established, the information of the optimum system obtained in step S33 is transmitted to the data field of the total system (S34).

The response car data information corresponding to hall-call assignment as the event is sent to all unit controllers **11-*l* to 11-*n*. The unit controller of the car to which the response is assigned controls to satisfy the corresponding hall call on the basis of the response car data information. When transmission is completed in step S34, the sync management process (FIG. 13**) completes the hall-call assignment job and monitors the next event.

As described above, the assignment control function is regarded as one job in units of hall calls, the job is divided into one process for managing sync control of this job and n processes for n elevators for performing car unit control. The (n+1) processes are assigned to m group controllers **10-*l* to 10-*n* by the scheduling management mechanism in accordance with their active/inactive states so as to equal load assignment. The plurality of processes assigned by one process for managing the sync control of the job are correlated through the data field of the group control system Therefore, group controllers 10-*l* to 10-*m*** execute the group control function as a hall-call assignment in a cooperative manner. The group management loads are automatically and always distributed in accordance with the active/inactive states, thereby creating a flexible distributed control system free from the centralized management mechanism. The group control system can be arranged not on the basis of the number of elevators and their models, but on the basis of the control function of the control system, i.e., the computer processing capacity.

The communication line different from that of the group control system is arranged by the hierarchical data field structures, and the unit control systems are free from the operations of the group control systems, thereby improving system reliability. As a result, reliability of the unit control systems can be improved A variable load distribution function based on the active/inactive states of the controllers can allow improvement of reliability of the group control system.

The present invention is not limited to the particular embodiment described above. Various changes and modifications may be made without departing from the spirit and scope of the invention.

Figure 2B:
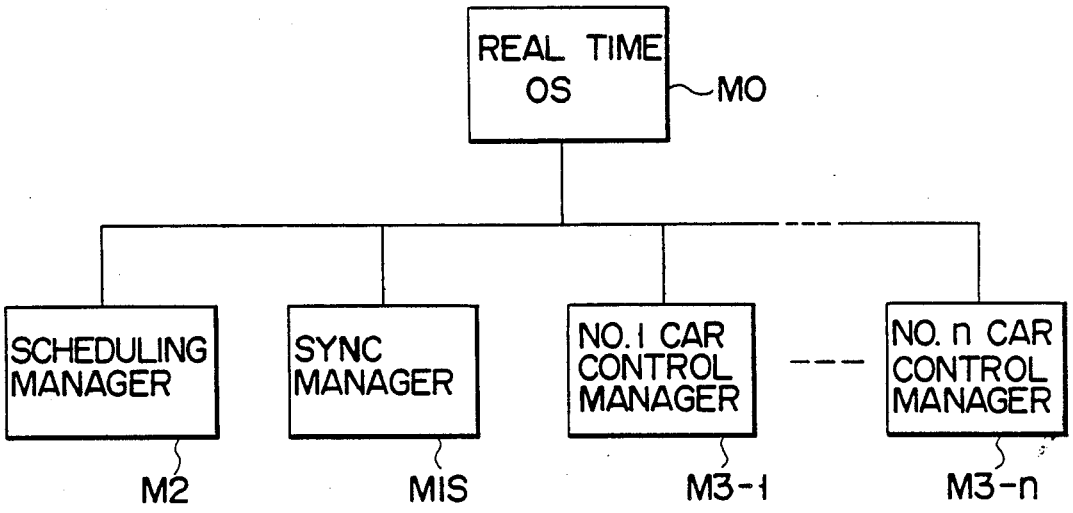

FIG. 2B shows a system configuration of a software system of group controllers **10-*l* to 10-*m* according to another embodiment of the present invention. Each of m group controllers 10-*l* to 10-*m* for controlling the group control function comprises sync manager MIS having a hall-call unit sync control function for each hall-call assignment function job in units of hall calls for n controllers, and No. 1** car to No. n control managers M3-*l* to M3-*n* having unit sync control functions of the respective cars.

The n processes are assigned to m group controllers 10-*l* to 10-*m* shown in FIG. 1 by scheduling manager M2 such that the group control system load processes are equal to each other in accordance with the number of active controllers.

Scheduling manager M2 has an arrangement for on-line monitoring the active group control systems by the data field of the group control system via high-speed transmission system 1 shown in FIG. 1. Manager M2 has a function for automatically performing optimum real-time load distribution in the present status for each of randomly generated call assignment jobs.

No. 1 to n control managers M3-*l* to M3-*n* have identical processing algorithms and their control areas are independent of each other in units of cars. Processes as independent tasks are registered in real-time operating system M0. Upon data exchange with the data field of the group control system, this operating system M0 autonomously determines whether a corresponding car can respond to a hall call generated under the sync control of sync manager MIS.

Sync manager MIS having a hall-call sync control function performs start/abort management of the No. 1 to n car control manager processes executed by m distributed group controllers 10-*l* to 10-*m*. Sync manager MIS matches a timing of each hall call for group controllers 10-*l* to 10-*m* for performing independent and asynchronous parallel operations for n systems and assigned to the m computers. At the same time, manager MIS has an arrangement for transmitting a message to a plurality of tasks and supporting message reception wait management. Manager MIS has a basic management function for supporting a sync function for each hall-call execution unit in independent and asynchronous parallel processes such as a time-out process by time management and an abort process by task monitoring. In addition, manager MIS also serves as a management mechanism for performing queueing management for a request having a priority in hall-call generation jobs and a long-period wait recheck jobs which are asynchronously and independently generated.

The content of the data field of the total system is limited, as shown in FIG. 10A. The influences of the complex group control function for performing large-capacity data communication by distributed control and requiring a large computer load on elevator car unit controllers 11-*l* to 11-*n* a system-down of which is decisive can be eliminated to improve reliability of elevator car unit controllers 11-*l* to 11-*n*.

Elevator status information of n elevators of n systems is sent on the data field of the total system. Therefore, the assignment rights of the elevator car unit controllers for controlling elevator car unit control processes are equally assigned to m group controllers 10-*l* to 10-*m*.

The data field of the group control system used in the arrangement of FIG. 2B is the same as that in FIG. 2A. This data field is classified into a data field of common information (i), a data field of n car control information (ii), m group control information (iii). The fields of the information (i) and the information (ii) are information fields which are exchanged between the n divided control processes in each event such as a hall-call unit assignment job. The field of information (iii) is an information field used for the scheduling management for averaging and assigning the plurality of processes for the call assignment jobs in the respective controllers.

Figure 16:
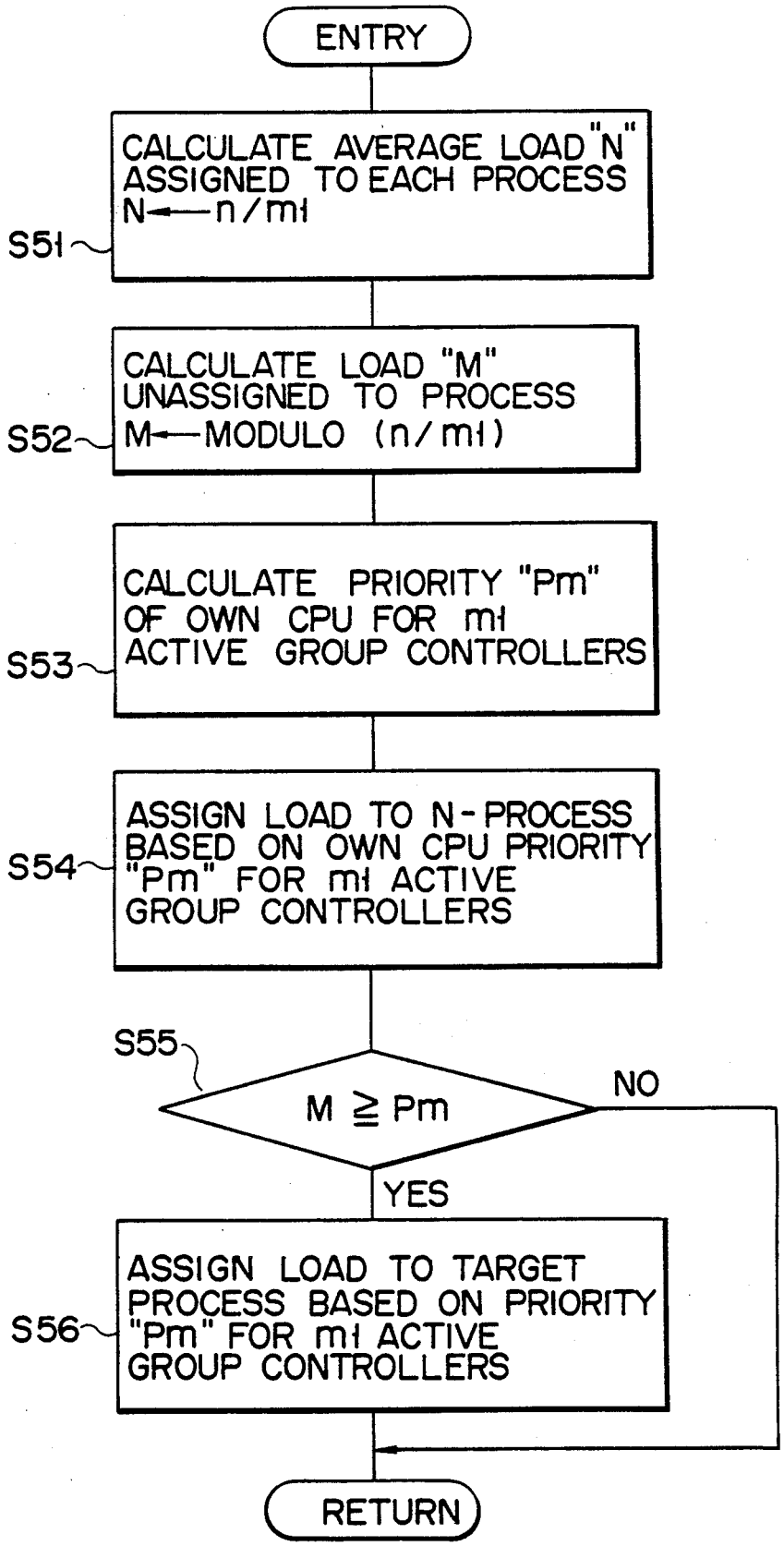
FIG. 16 is a flow chart showing scheduling management in the arrangement of FIG. 2B.
Figure 17:
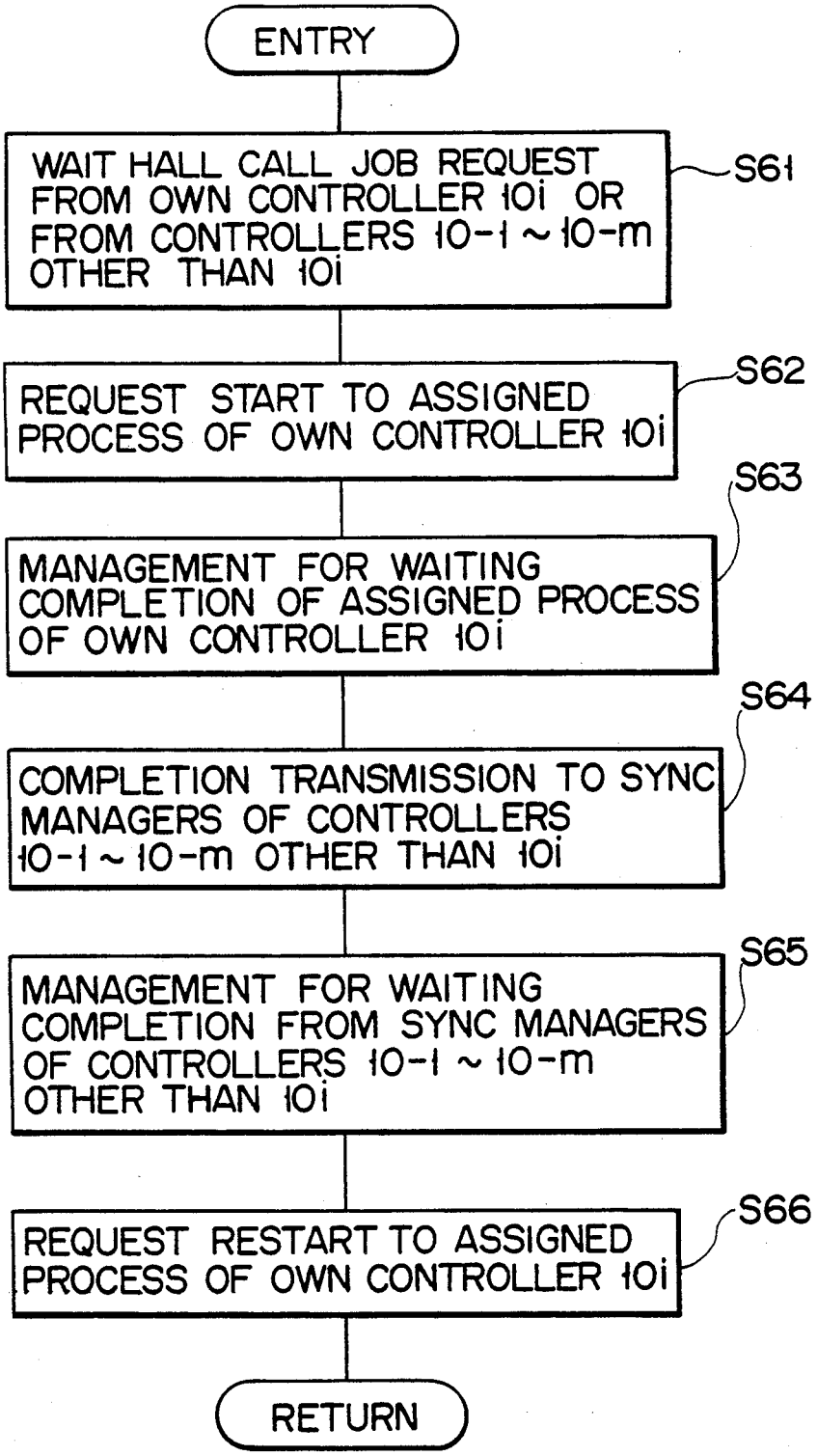
FIG. 17 is a flow chart showing a sync management operation in the arrangement of FIG. 2B.
Figure 18:
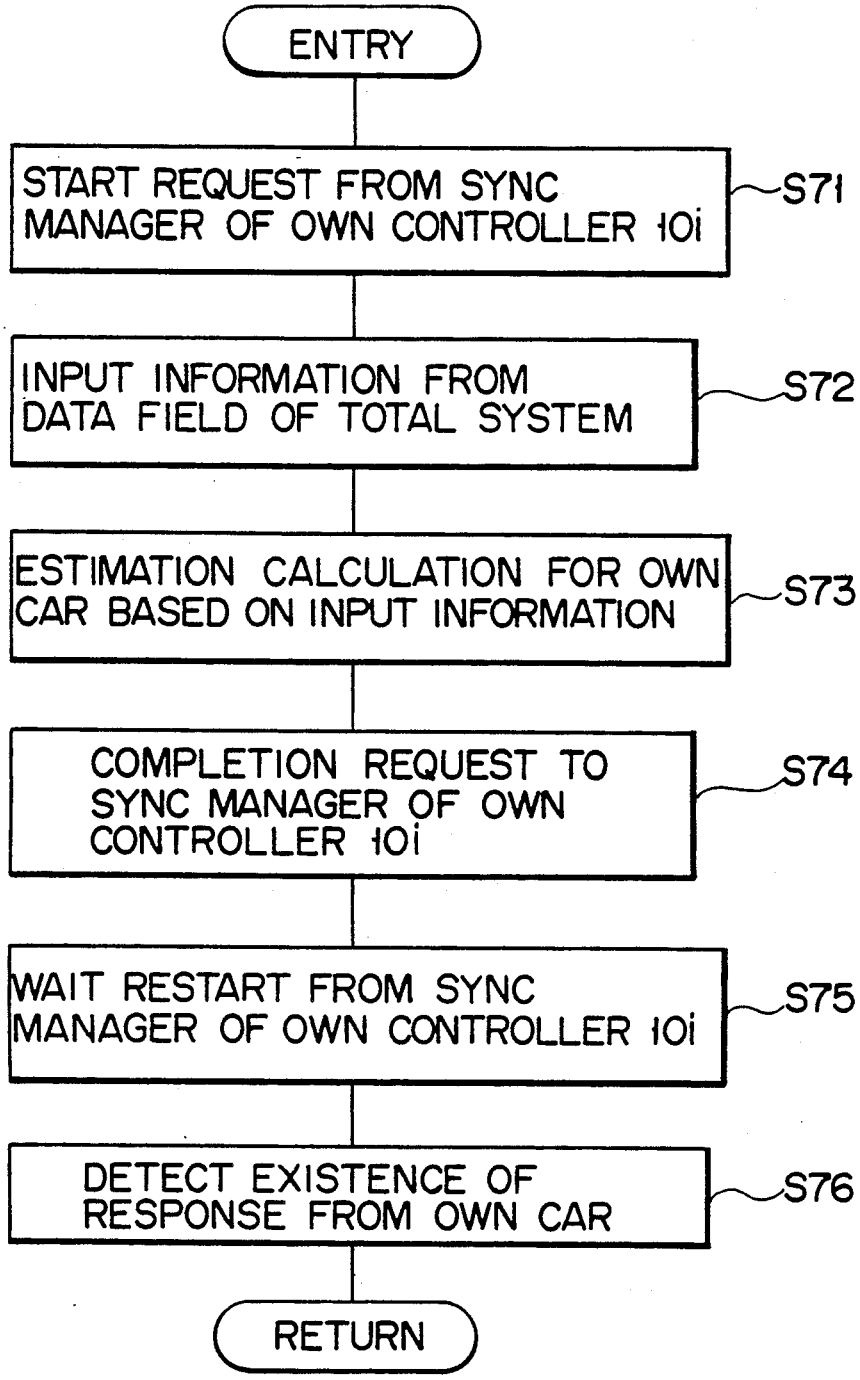
FIG. 18 is a flow chart showing car unit process operation in the arrangement of FIG. 2B.
Figure 19:
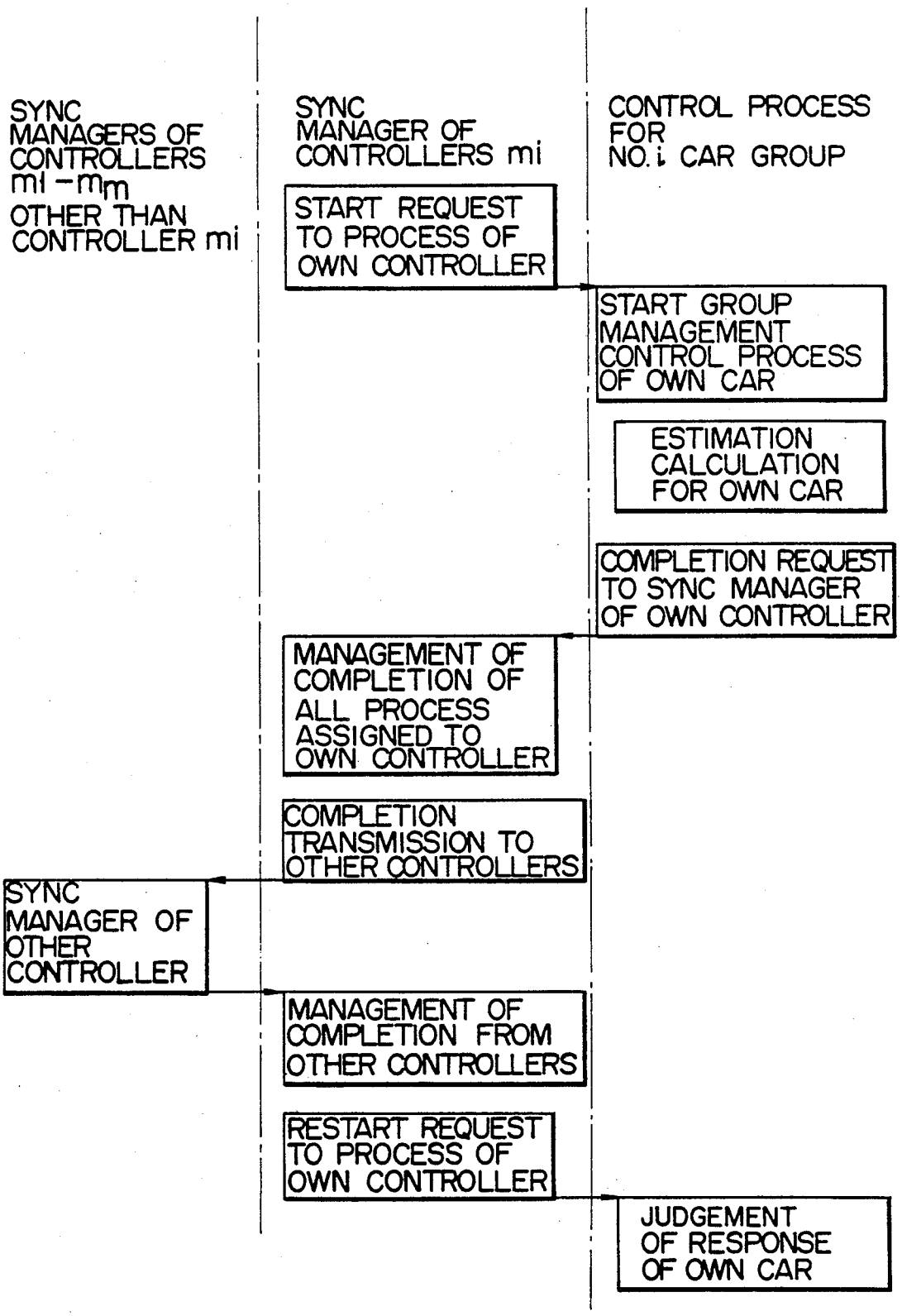
FIG. 19 is a block diagram showing operation transition of sync managers of own and other group control computers and the own car unit processor.

FIG. 16 is a flow chart showing a scheduling management operation according to the present invention. n+1 in FIG. 11 is replaced with n in FIG. 16. FIG. 17 is a flow chart showing a control operation of the sync manager of the present invention. FIG. 18 is a flow chart showing an operation of each process in the car control manager according to the present invention. FIG. 19 is an operational block diagram showing status transition of each process of the sync manager and car control manager in each CPU ($m_l$ to $m_m$) in each of m group controllers 10-*l* to 10-*m* of the present invention.

As shown in the flow chart of FIG. 16, m group controllers 10-*l* to 10-*m* perform on-line process load assignment of n systems. In order to execute load assignment, the number of m active systems is monitored by monitoring the data field of the group control system, and the number of control systems assigned to the group control functions is calculated. Average assignment load N of loads assigned to n processes of the No. 1 to n control managers which are obtained by dividing the hall-call assignment control function into a plurality of processes for the calculated systems is calculated (S51). Unassigned load M of the processes is then calculated (S52).

The own system numbers of the m group controllers and own CPU priorities Pm in the active systems are calculated or determined (S53). More specifically, the control processes of the No. 1 to n car control processes are regarded as equal loads, and priorities Pm are solely determined. The control process as the average load process is assigned to the corresponding controller in accordance with own CPU priority Pm (S54 to S56). The control processes corresponding to the priorities are assigned to the m1 active systems in the m systems.

The number of m systems according to the present invention is not a fixed number and all the m systems are not always normally operated. All process assignment is not always completed by assignment of the above-mentioned processes. For this reason, the unassigned M load processes are compared with the calculated priority Pm of the own CPU. If a process to be assigned to each of the M systems is present, the unassigned process is assigned in addition to the average load to the corresponding one of the M systems in the same manner as in the assignment algorithm of the average load algorithm. The n control processes for each hall call are autonomously assigned to m group controllers 10-*l* to 10-*m* in accordance with their degrees of operations.

According to scheduling management by the algorithm shown in the flow of FIG. 16, since no predetermined relationship between the m group control systems and the n elevators is established, the number of group control systems can be arbitrarily set in accordance with the number of floors, the grades of elevator models, and the like. In addition, if at least one of the m systems is normally operated, the total function can be satisfied.

The plurality of n processes assigned to the active systems by the scheduling management are controlled in units of hall calls. The flow of FIG. 17 is executed in an event such as generation of a hall call and long-period wait rechecking. More specifically, each of the sync managers in m group controllers 10-*l* to 10-*m* (No.

l to m systems are active) waits a hall-call job request from its own controller **10-*i* or from controllers to 10-*m* other than controller 10-*i* in an order of controllers from the controller which detects the hall-call request job first (S61**).

When a hall-call job is requested, each of the m sync managers requests start to an assigned process of its own controller **10-*i* which is selected from the n car unit processes assigned to CPUs in accordance with the active status of the m group controllers (S62). The management for waiting completion of the assigned process of its own controller 10-*i* is performed (S63**).

Each car unit process is then executed in response to the start request in step S62. The CPU of this car calculates a car evaluation assigned to this car on the basis of the data from the data file of the total system (S71 to S73). When evaluation calculations of the respective cars are completed, control is shifted to the sync manager of its own CPU (S74). The sync manager of its own CPU monitors completion of all car unit processes assigned to its own CPU and matches the timing for completion of load processing of its own CPU.

Upon completion of all car unit processes assigned to the sync manager of its own CPU, the sync manager performs completion transmission to the sync managers of controllers **10-*l* to 10-*m* other than controller 10-*i* (S64). At the same time, the sync manager of its own CPU monitors completion of the No. 1 to n car unit processes (S65). Upon this completion, each of the sync managers of the m CPUs requests restart to the assigned process of its own controller 10-*i* (S66). The No. 1 to n car unit processes independently, asynchronously, and autonomously detect existence of responses from their own cars (S75 and S76**). When the assigned car is detected as described above, information is transmitted to each unit controller through the data field of the total system.

FIG. 19 shows a status transition chart of the operations of each controller of FIGS. 17 and 18.

As described above, each sync manager of an active CPU in each of the m group controllers establishes synchronization of an asynchronously, independently input hall-call assignment job while the active CPUs communicate with each other. The active CPUs cooperate with each other, and the processes are independently executed while the loads are averaged (distributed) to the CPUs by the scheduling management. Therefore, the car unit processes (mainly evaluation calculations) serving as control loads are executed with a good balance in the total system. Each process independently detects the existence of the response of its own car, and the group control function can be performed as a whole. In addition, the car unit processes can be rearranged and executed in any of the m CPUs. Therefore, the m group control systems can serve as group control systems having autonomous controllability and autonomous cooperativeness.

As described above, the assignment control function for each hall call is regarded as one job in this system. This job is divided into n-car, n-system processes for performing car unit control under the control of sync managers. The n processes are assigned to average the loads by the scheduling management mechanism in accordance with the active/inactive states of the m group controllers. The plurality of processes are correlated through the data field of the group control system. The group control function as hall-call assignment is performed while group controllers cooperate with each other. Therefore, the group control loads can be automatically distributed in accordance with the active/inactive states of the group controllers, thereby creating the flexible distributed control system without using the centralized management mechanism. It is possible to set the group control system not on the basis of the number of elevators and/or the elevator models, but on the basis of the control function of the control system, i.e., the computer processing capacity. Since the data fields have hierarchical structures, reliability of unit controllers can be improved. In addition, reliability of the group control system can also be improved by a variable load distribution function (cf. FIG. 11 or FIG. 16) based on the active states.

The present invention is not limited to the particular embodiments described above. Various changes and modifications may be made without departing from the spirit and scope of the invention.

According to the present invention as has been described above, the group control function is divided into a plurality of control processes in units of hall-call events. These control processes can be independently executed and can be rearranged. The process load assignment is automatically performed by the scheduling function in accordance with active control systems. Therefore, the control loads can be averaged and distributed, thereby creating a distributed group control system without using a centralized management mechanism. At the same time, a system-down due to a failure of some group control systems tends not to occur, so that it is possible to maintain cooperative control of the control systems. That is, flexibility and versatility are provided to the system which is fixed by the number of number of cars and the grades of the elevator models. Therefore, the system can be determined by the computer processing capacity.

A system-down of the overall group control system by partial system-down can be prevented by cooperative control of the control systems. Therefore, reliability of the group management can be improved. In addition, no fixed relationship between each unit controller and each group controller is established, so that the unit controllers are not adversely affected by the group controllers. Reliability of unit controllers can be improved.

On the other hand, according to the present invention, the group control function is divided into a plurality of control processes which can be independently executed and can be rearranged. Each group controller uses the scheduling function to automatically, independently, and autonomously perform process load assignment in accordance with the active control systems. The control loads are averaged and distributed, thereby creating a distributed group control system without using a centralized management mechanism. A system-down due to a failure of some group control systems tends not to occur, so that it is possible to maintain cooperative control of the control systems. That is, flexibility and versatility are provided to the system which is fixed by the number of number of cars and the grades of the elevator models. Therefore, the system can be determined by the computer processing capacity. A system-down of the overall group control systems by partial system-down can be prevented by cooperative control of the control systems. Therefore, reliability of the group management can be improved. In addition, no fixed relationship between each unit controller and each group controller is established, so that the unit controllers are not adversely affected by the group controllers. Reliability of unit controllers can be improved.

What is claimed is:

1. An apparatus for performing group control on elevators, wherein a plurality of elevators are operated for a plurality of floors, a predetermined evaluation calculation is performed for each of the plurality of elevators upon generation of a hall call, an optimum elevator car is selected on the basis of an evaluation calculation result, and the selected elevator car is assigned to the hall call, thereby responding to the hall call, said apparatus comprising:

unit control means, arranged in units of cars of the elevators, for controlling unit control of each car and inputting/outputting information associated with its own car;

a plurality of group control means for performing the evaluation calculation for determining hall-call assignment in units of cars on the basis of the information associated with its own car and for performing group management of each elevator car on the basis of an evaluation calculation result; and communicating means for causing said plurality of group control means to communicate with each other through a first data field and causing said unit control means and said group control means to communicate with each other through a second data field independent from said first data field.

2. An apparatus according to claim 1, wherein said group control means includes: means for performing a scheduling process, said scheduling process monitoring active ones of said plurality of group control means so as to determine priorities of said active group control means, and assigning group control processes to distribute group control process loads to said active group control means on the basis of the priorities.

3. An apparatus according to claim 1 or 2, wherein said group control means includes:

means for performing an information exchange process for exchanging the information associated with its own car;

means for performing an evaluation calculation process for performing the evaluation calculation in units of cars upon hall-call assignment on the basis of the information exchanged by said information exchange process; and means for performing an instruction process for instructing execution of the evaluation calculation to said evaluation calculation process upon generation of the hall call, for assigning the optimum elevator car upon reception of an evaluation calculation result, and completing said evaluation calculation process.

4. An apparatus according to claim 1, wherein said group control means includes: means for performing a scheduling process, said scheduling process monitoring active ones of said plurality of group control means to determine priorities of said active group control means, and assigning group control processes to distribute group control process loads to said active group control means on the basis of the priorities and the number of active group control means.

5. An apparatus according to claim 1 or 4, wherein said group control means includes means for performing an information exchange process for exchanging the information associated with its own car;

means for performing an evaluation calculation process for performing the evaluation calculation in units of cars upon hall-call assignment on the basis of the information exchanged by said information exchange process; and means for performing an instruction process for instructing execution of the evaluation calculation to said evaluation calculation process upon generation of the hall call, for assigning the optimum elevator car upon reception of an evaluation calculation result, and completing said evaluation calculation process.

6. An apparatus for performing group control on elevators, wherein a plurality of elevators are operated for a plurality of floors, a predetermined evaluation calculation is performed for each of the plurality of elevators upon generation of a hall call, an optimum elevator car is selected on the basis of an evaluation calculation result, and the selected elevator car is assigned to the hall call, thereby responding to the hall call, said apparatus comprising:

unit control means, arranged in units of elevator cars, for controlling unit control of each elevator car and inputting/outputting information associated with its own car;

a plurality of group control means each having a first process for exchanging each car information, a second process for determining a priority of its own by monitoring each active group control means and for scheduling load distribution and assignment of group control processes on the basis of the determined priority, a third process for performing evaluation calculations in units of cars for hall-call assignment on the basis of each car information, and a fourth process for instructing execution of the third process upon occurrence of a hall call, waiting an evaluation calculation result obtained by the execution of the third process, assigning an optimum car upon reception of the evaluation result from the third process, and generating an end instruction to the third process; and communicating means for establishing connecting said unit control means and said group control means to each other and between said group control means, and performing communication with each unit control means in a data field different from that for each group control means.

7. An apparatus for performing group control on elevators, wherein a plurality of elevators are operated for a plurality of floors, a predetermined evaluation calculation is performed for each of the plurality of elevators upon generation of a hall call, an optimum elevator car is selected on the basis of an evaluation calculation result, and the selected elevator car is assigned to the hall call, thereby responding to the hall call, said apparatus comprising:

unit control means, arranged in units of elevator cars, for controlling unit control of each elevator car and inputting/outputting information associated with its own car;

a plurality of group control means each having a first process for exchanging each car information, a second process for determining a priority of its own by monitoring each active group control means and for scheduling load distribution and assignment of processes including car assignment so as to assign average loads of group control in correspondence with the number of active group control means and the priority on the basis of the determined priority, a third process for performing evaluation calculations for hall-call assignment on the basis of information of each car of process assignment upon reception of an instruction and for sending back the evaluation result to an instruction source, and a fourth process for instructing execution of the third process upon occurrence of a hall call, waiting an evaluation calculation result obtained by the execution of the third process, assigning an optimum car upon reception of the evaluation result from the third process, and generating an end instruction to the third process; and communicating means for connecting said unit control means and said group control means to each other and between said group control means, and performing communication with each unit control means in a data field different from that for each group control means.

8. A control method used in an apparatus for performing group control on elevator cars, wherein the apparatus includes a unit control means in each elevator car, a plurality of group control means, and communicating means for communication among said unit control means and said group control means, said method comprising the steps of:

inputting and outputting information associated with each car through said unit control means;

communicating among said plurality of group control means through a first data field;

communicating among said unit control means and said group control means through a second data field independent from said first data field;

generating a hall call;

performing a predetermined evaluation calculation for each of the plurality of elevator cars on the basis of information associated with each car;

selecting an optimum elevator car on the basis of results of the evaluation calculations; and assigning the optimum elevator car to the hall call.

9. The method according to claim 8, further comprising the steps of:

monitoring active ones of said plurality of group control means;

determining priorities of said active group control means; and distributing group control process loads to said active group control means on the basis of the priorities determined.

10. The method according to claim 8 or 9, further comprising the steps of:

exchanging information associated with each car;

performing the evaluation calculation on the basis of the information exchanged; and instructing execution of the evaluation calculation upon generation of the hall call.

11. The method according to claim 8, further comprising the steps of:

monitoring active ones of said plurality of group control means to determine priorities of said carbon active group control means; and distributing group control process loads to said active group control means on the basis of the priorities and the number of active group control means.

12. A method according to either of claims 8 or 11, further comprising the steps of:

exchanging information associated with each car; and performing the evaluation calculations on the basis of the information exchanged.

* * * * *